US010656558B1

(12) United States Patent
Morooka et al.

(10) Patent No.: US 10,656,558 B1
(45) Date of Patent: May 19, 2020

(54) IMAGE FORMING APPARATUS AND TONER CARTRIDGE

(71) Applicant: FUJI XEROX Co., Ltd., Tokyo (JP)

(72) Inventors: Yasuhisa Morooka, Kanagawa (JP); Takafumi Koide, Kanagawa (JP); Yusuke Fukuda, Kanagawa (JP); Katsuyuki Kitajima, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/539,135

(22) Filed: Aug. 13, 2019

(30) Foreign Application Priority Data

Feb. 28, 2019 (JP) ..... 2019-036664

(51) Int. Cl.
*G03G 15/08* (2006.01)

(52) U.S. Cl.
CPC ..... *G03G 15/0868* (2013.01); *G03G 15/087* (2013.01); *G03G 15/0867* (2013.01);
(Continued)

(58) Field of Classification Search
CPC ..... G03G 15/0867; G03G 15/0868; G03G 15/087; G03G 15/0872; G03G 2215/066;
(Continued)

(56) References Cited

U.S. PATENT DOCUMENTS

| | | | | |
|---|---|---|---|---|
| 6,040,104 | A | 3/2000 | Nakamura et al. | |
| 2005/0226656 | A1 | 10/2005 | Tsuda et al. | |
| 2018/0011420 | A1* | 1/2018 | Arai | G03G 15/0886 |

FOREIGN PATENT DOCUMENTS

| | | | | |
|---|---|---|---|---|
| EP | 0373652 A2 * | 6/1990 | ..... | G03G 15/2064 |
| JP | 02161458 A * | 6/1990 | ..... | G03G 9/09364 |

(Continued)

*Primary Examiner* — Joseph S Wong
(74) *Attorney, Agent, or Firm* — Sughrue Mion PLLC

(57) ABSTRACT

An image forming apparatus includes an image carrier; a charging section that charges the surface of the image carrier; an electrostatic-charge-image-forming section that forms an electrostatic charge image on the charged surface of the image carrier; a developing section that contains toner for electrostatic charge image development and develops the electrostatic charge image on the surface of the image carrier into a toner image using the toner; a replenishment toner supplying section that supplies the toner to the developing section, the replenishment toner supplying section including a replenishment toner cartridge, the replenishment toner cartridge containing the toner, having a cap and a body, and detachably attached to the image forming apparatus, the cap being at a first axial end of the replenishment toner cartridge and having an outlet for the replenishment toner to be ejected therethrough, whereas the body having a ridged portion by which the toner inside is moved in the direction from a second axial end of the replenishment toner cartridge to the outlet as the body rotates; a transfer section that transfers the toner image formed on the surface of the image carrier to the surface of a recording medium; and a fixing section that fixes the toner image transferred to the surface of the recording medium. The toner satisfying the following relations: $(\ln \eta(T1)-\ln \eta(T2))/(T1-T2)\leq -0.14$; $(\ln \eta(T2)-\ln \eta(T3))/(T2-T3)\geq -0.15$; and $(\ln \eta(T1)-\ln \eta(T2))/(T1-T2)<(\ln \eta(T2)-\ln \eta(T3))/(T2-T3)$, where $\eta(T1)$ represents a viscosity of the toner at 60° C., $\eta(T2)$ represents a viscosity of the toner at 90° C., and $\eta(T3)$ represents a viscosity of the toner at 130° C.

16 Claims, 3 Drawing Sheets

(52) U.S. Cl.
CPC ... *G03G 15/0872* (2013.01); *G03G 2215/066* (2013.01); *G03G 2215/0663* (2013.01); *G03G 2215/0665* (2013.01); *G03G 2215/0685* (2013.01)

(58) Field of Classification Search
CPC ... G03G 2215/0663; G03G 2215/0665; G03G 2215/0685
See application file for complete search history.

(56) References Cited

FOREIGN PATENT DOCUMENTS

| | | | |
|---|---|---|---|
| JP | 11-194542 | A | 7/1999 |
| JP | 2004-139031 | A | 5/2004 |

* cited by examiner

IMAGE FORMING APPARATUS AND TONER CARTRIDGE

CROSS-REFERENCE TO RELATED APPLICATIONS

This application is based on and claims priority under 35 USC 119 from Japanese Patent Application No. 2019-036664 filed Feb. 28, 2019.

BACKGROUND

(i) Technical Field

The present disclosure relates to an image forming apparatus and a toner cartridge.

(ii) Related Art

Nowadays electrophotography and other methods of visualizing image information via an electrostatic charge image are used in various fields.

In the related art, electrophotography visualizes image information typically through the multiple operations of forming an electrostatic charge image on a photoreceptor or electrostatic recording medium by any of various techniques, developing the electrostatic charge image (toner image) by attaching electrosensitive particles called toner to the electrostatic charge image, transferring the toner image to the surface of a substrate, and fixing the transferred image, for example by heating.

Japanese Laid Open Patent Application Publication No. 2004-139031 discloses "an image forming apparatus that includes a process cartridge and a replenishment toner cartridge. The process cartridge includes a developing device, and the developing device has a developer transport member and a toner-containing section. The developer transport member holds a developer on the surface thereof and transports the developer to a developing region, a region facing a latent image carrier, and the toner-containing section contains toner. The developing device supplies the toner in the toner cartridge to the developer transport member or the developer held on the developer carrier. The replenishment toner cartridge supplies replenishment toner to the toner-containing section. Each of the process cartridge and the replenishment toner cartridge is attachable to and detachable from the body of the image forming apparatus, and the body of the image forming apparatus has a toner transport section that transports the replenishment toner from the replenishment toner cartridge to the toner-containing section using the own weight of the toner."

Japanese Laid Open Patent Application Publication No. 11-194542 discloses "an electrophotographic toner that includes a binder resin and a coloring agent. The binder resin has its minimum tan δ at a temperature between its glass transition temperature (Tg) and the temperature at which its loss modulus (G")=$1\times10^4$ Pa. The minimum tan δ is less than 1.2, and at the temperature at which the tan δ is at its minimum, the resin has a storage modulus (G')=$5\times10^5$ Pa or more. At the temperature at which G"=$1\times10^4$ Pa, the tan δ is 3.0 or more."

A type of replenishment toner cartridge moves the replenishment toner contained therein to an outlet and supplies the replenishment toner by rotating (hereinafter also referred to as a "rotary container for replenishment toner"). An image forming apparatus that uses a rotary container for replenishment toner, however, can have difficulty in supplying the replenishment toner in the container when forming an image under high-temperature and high-humidity conditions (e.g. 28° C. and 85% RH) or forming an image with a high area coverage (e.g., 100%) under low-temperature and low-humidity conditions (e.g., 10° C. and 15% RH) in certain use environments.

SUMMARY

Aspects of non-limiting embodiments of the present disclosure relate to image forming apparatuses that use a rotary container for replenishment toner and provide an image forming apparatus that rarely suffers inadequate supply of replenishment toner in comparison with those that use a toner for developing an electrostatic charge image with a (ln η(T1)−ln η(T2))/(T1−T2) exceeding −0.14 or a (ln η(T2)−ln η(T3))/(T2−T3) of less than −0.15 even when forming an image under high-temperature and high-humidity conditions or an image with a high area coverage under low-temperature and low-humidity conditions.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including: an image carrier; a charging section that charges the surface of the image carrier; an electrostatic-charge-image-forming section that forms an electrostatic charge image on the charged surface of the image carrier; a developing section that contains toner for electrostatic charge image development and develops the electrostatic charge image on the surface of the image carrier into a toner image using the toner; a replenishment toner supplying section that supplies the toner to the developing section, the replenishment toner supplying section including a replenishment toner cartridge, the replenishment toner cartridge containing the toner, having a cap and a body, and detachably attached to the image forming apparatus, the cap being at a first axial end of the replenishment toner cartridge and having an outlet for the replenishment toner to be ejected therethrough, whereas the body having a ridged portion by which the toner inside is moved in the direction from a second axial end of the replenishment toner cartridge to the outlet as the body rotates; a transfer section that transfers the toner image formed on the surface of the image carrier to the surface of a recording medium; and a fixing section that fixes the toner image transferred to the surface of the recording medium.

The toner satisfies the following relations:

$$(\ln \eta(T1)-\ln \eta(T2))/(T1-T2)\leq-0.14;$$

$$(\ln \eta(T2)-\ln \eta(T3))/(T2-T3)\geq-0.15;\text{ and}$$

$$(\ln \eta(T1)-\ln \eta(T2))/(T1-T2)<(\ln \eta(T2)-\ln \eta(T3))/(T2-T3),$$

where η(T1) represents the viscosity of the toner at 60° C., η(T2) represents the viscosity of the toner at 90° C., and η(T3) represents the viscosity of the toner at 130° C.

BRIEF DESCRIPTION OF THE DRAWINGS

An exemplary embodiment of the present disclosure will be described in detail based on the following figures, wherein.

DETAILED DESCRIPTION

Figure 1:
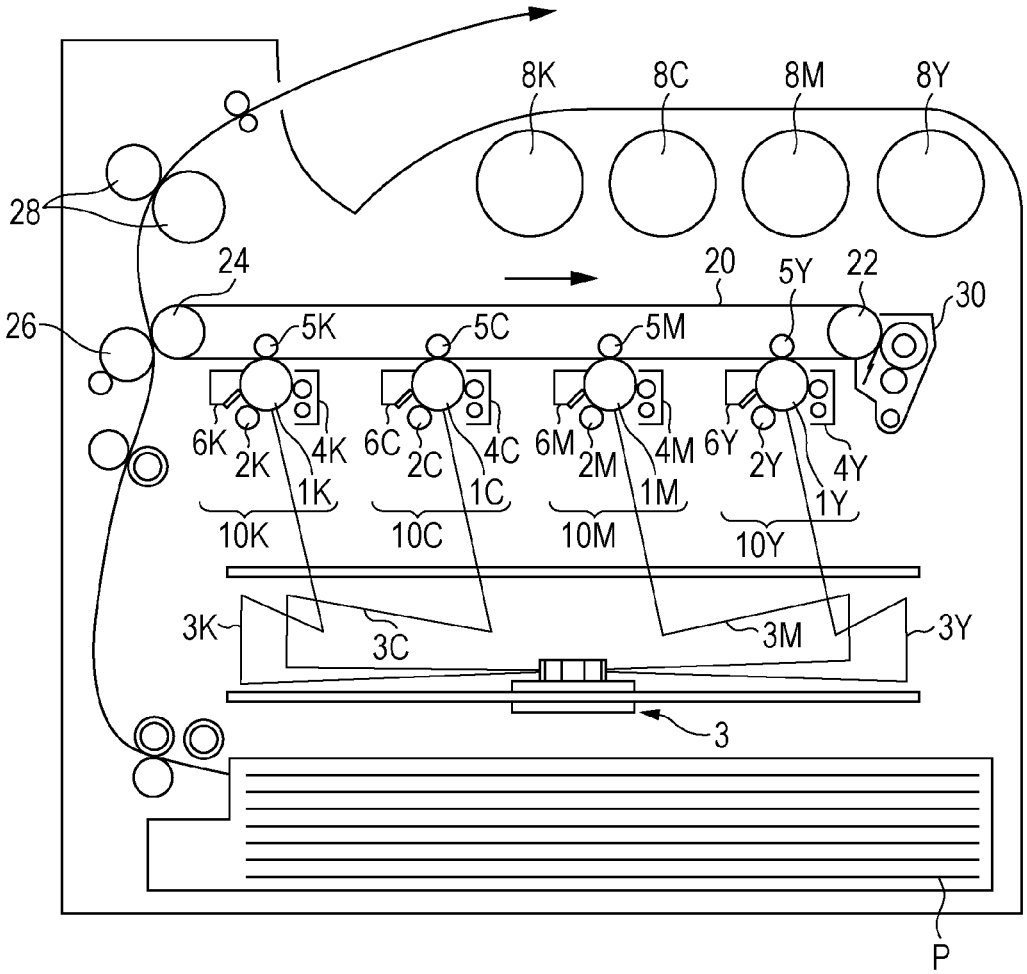
FIG. 1 schematically illustrates the structure of an image forming apparatus according to this exemplary embodiment.

If a composition described herein contains a combination of multiple substances as an ingredient, the amount of the ingredient represents the total amount of the substances in the composition unless stated otherwise.

"A toner for electrostatic charge image development" herein may be referred to simply as "a toner." "An electrostatic-charge-image developer" herein may be referred to simply as "a developer."

The following describes an exemplary embodiment as an example of the present disclosure.

Image Forming Apparatus

An image forming apparatus according to this exemplary embodiment is described.

An image forming apparatus according to this exemplary embodiment includes an image carrier; a charging section that charges the surface of the image carrier; an electrostatic-charge-image-forming section that forms an electrostatic charge image on the charged surface of the image carrier; a developing section that contains toner for electrostatic charge image development and develops the electrostatic charge image on the surface of the image carrier into a toner image using the toner; a replenishment toner supplying section that supplies the toner to the developing section, the replenishment toner supplying section including a replenishment toner cartridge, the replenishment toner cartridge containing the toner, having a cap and a body, and detachably attached to the image forming apparatus, the cap being at a first axial end of the replenishment toner cartridge and having an outlet for the replenishment toner to be ejected therethrough, whereas the body having a ridged portion by which the toner inside is moved in the direction from a second axial end of the replenishment toner cartridge to the outlet as the body rotates; a transfer section that transfers the toner image formed on the surface of the image carrier to the surface of a recording medium; and a fixing section that fixes the toner image transferred to the surface of the recording medium.

The electrostatic-charge-image developer is one that includes a specific toner for electrostatic charge image development. The toner includes toner particles and satisfies the following relations:

$$(\ln \eta(T1)-\ln \eta(T2))/(T1-T2)\leq -0.14;$$

$$(\ln \eta(T2)-\ln \eta(T3))/(T2-T3)\geq -0.15; \text{ and}$$

$$(\ln \eta(T1)-\ln \eta(T2))/(T1-T2)<(\ln \eta(T2)-\ln \eta(T3))/(T2-T3),$$

where $\eta(T1)$ represents the viscosity of the toner at 60° C., $\eta(T2)$ represents the viscosity of the toner at 90° C., and $\eta(T3)$ represents the viscosity of the toner at 130° C. A toner for electrostatic charge image development having these characteristics may hereinafter be referred to simply as a "specific toner."

The replenishment toner supplying section includes a specific rotary container for replenishment toner. The replenishment toner supplying section has a replenishment toner cartridge having an axis of rotation of the replenishment toner cartridge. The replenishment toner cartridge contains replenishment toner and has a cap and a body. The cap is at the axial end of the replenishment toner cartridge and has an outlet for the replenishment toner to be ejected therethrough. The body has a ridged portion inside. As the body rotates, the replenishment toner inside is moved by the ridged portion in the direction from the other axial end of the replenishment toner cartridge to the outlet. The replenishment toner cartridge has been detachably attached to the image forming apparatus with the outlet serving as an interface.

A rotary container for replenishment toner has inside its body a ridged portion for transporting replenishment toner. A toner with low viscoelasticity, however, easily adheres to the ridged portion inside the body, and particles of the toner easily aggregate there. Image formation with a low-viscoelasticity toner under high-temperature and high-humidity conditions therefore can result in the aggregation of replenishment toner and the adhesion of the replenishment toner to the ridged portion inside the body of the rotary container for replenishment toner. With a highly viscoelastic and highly fluidic toner, however, forming an image with a high area coverage under low-temperature and low-humidity conditions causes tumbling of replenishment toner inside the body of the rotary container for replenishment toner because of rapid transport of the replenishment toner from the rotary container for replenishment toner. Low transport of replenishment toner can cause erroneous detection of the amount of toner remaining. In such a case, for example, the apparatus may display the replace toner massage despite toner remaining. Overall, image forming apparatuses that use a rotary container for replenishment toner can suffer inadequate supply of replenishment toner from the replenishment toner cartridge.

An image forming apparatus according to this exemplary embodiment, by contrast, is not as tend to inadequate supply of replenishment toner even when forming an image under high-temperature and high-humidity conditions (e.g., 28° C. and 85% RH) or an image with a high area coverage (e.g., 100%) under low-temperature and low-humidity conditions (e.g., 10° C. and 15% RH) by advantage of an image forming apparatus that uses a rotary container for replenishment toner being configured as described above with a toner that includes toner particles and has the specific characteristics set forth above. On the reason for this, the inventors speculate as follows.

First, the characteristics of a specific toner used in this exemplary embodiment are described. The formula $(\ln \eta(T1)-\ln \eta(T2))/(T1-T2)$ is a measure of how much the viscosity of the toner changes at temperatures from 60° C. to 90° C., and a $(\ln \eta(T1)-\ln \eta(T2))/(T1-T2)$ of −0.14 or less means that the toner greatly changes its viscosity at temperatures from 60° C. to 90° C. The formula $(\ln \eta(T2)-\ln \eta(T3))/(T2-T3)$, on the other hand, is a measure of how much the viscosity of the toner changes at temperatures from 90° C. to 120° C., and a $(\ln \eta(T2)-\ln \eta(T3))/(T2-T3)$ of −0.15 or more and greater than the $(\ln \eta(T1)-\ln \eta(T2))/(T1-T2)$ means that the toner changes little its viscosity at temperatures from 90° C. to 120° C. The specific toner therefore changes its viscosity sharply at temperatures from 60° C. to 90° C. and little at temperatures from 90° C. to 120° C.

In a toner that exhibits such a viscosity profile, the inventors believe, the binder resin contained in the toner particles has low-molecular-weight and high-molecular-weight components both in appropriate proportions. That is, a low-molecular-weight component in the binder resin promotes changes in viscosity at temperatures from 60° C. to 90° C., whereas a high-molecular-weight component in the binder resin limits changes in viscosity at high temperatures from 90° C. to 120° C.

By the characteristic of such a viscosity profile, the specific toner changes little its viscosity and has moderate viscoelasticity at temperatures from room temperature (e.g., 20° C.) to 60° C. That is, the presence of appropriate proportions of low- and high-molecular-weight components in the binder resin ensures that the specific toner is stable in viscosity and maintains moderate viscoelasticity at temperatures of 60° C. or below. The specific toner, having the characteristics specified above, is therefore stable in viscosity and has moderate viscoelasticity at temperatures from room temperature to 60° C.

To be more specific, a $(\ln \eta(T1)-\ln \eta(T2))/(T1-T2)$ of −0.14 or less limits the aggregation of the replenishment toner because the viscoelasticity of the toner is not too low by the characteristic of the appropriate proportions of both low- and high-molecular-weight components. A $(\ln \eta(T1)-\ln \eta(T2))/(T1-T2)$ of −0.14 or less therefore also limits the adhesion of replenishment toner inside the body of the rotary container for replenishment toner to the ridged portion that the body of the rotary container for replenishment toner has inside. A $(\ln \eta(T2)-\ln \eta(T3))/(T2-T3)$ of −0.15 or more and greater than the $(\ln \eta(T1)-\ln \eta(T2))/(T1-T2)$, on the other hand, limits the rolling of the replenishment toner inside the body of the rotary container for replenishment toner because the viscoelasticity of the toner is not too high by the characteristic of the appropriate proportions of both low and high molecular weight components. In other words, this exemplary embodiment uses the aforementioned specific toner, which is a toner having moderate viscoelasticity. By advantage of the foregoing advantages of the specific toner, an image forming apparatus according to this exemplary embodiment rarely suffers inadequate supply of replenishment toner even when forming an image under high-temperature and high-humidity conditions or an image with a high area coverage under low-temperature and low-humidity conditions (hereinafter also expressed simply as (the apparatus) reduces inadequate supply of replenishment toner).

An image forming apparatus according to this exemplary embodiment performs a method of image formation that includes charging, in which the surface of the image carrier is charged; electrostatic charge image formation, in which an electrostatic charge image is formed on the charged surface of the image carrier; development, in which the electrostatic charge image formed on the surface of the image carrier is developed into a toner image using an electrostatic charge image developer that has a specific toner; supplying of a specific replenishment toner as defined above, in which replenishment toner is fed to the developing section; transfer, in which the toner image formed on the surface of the image carrier is transferred to the surface of a recording medium; and fixation, in which the toner image transferred to the surface of the recording medium is fixed.

The scope of application of an image forming apparatus according to this exemplary embodiment includes known types of image forming apparatuses, such as direct transfer apparatuses, which operate by forming a toner image on the surface of an image carrier and transferring it directly to a recording medium; intermediate transfer apparatuses, which operate by forming a toner image on the surface of an image carrier, transferring it to the surface of an intermediate transfer body (first transfer), and then transferring the toner image on the surface of the intermediate transfer body to the surface of a recording medium (second transfer); apparatuses that include a cleaning section that cleans the surface of the image carrier between the transfer of a toner image and charging; and apparatuses that include a erasing section that removes static electricity from the surface of the image carrier by irradiation with antistatic light between the transfer of a toner image and charging.

If an image forming apparatus according to this exemplary embodiment is an intermediate transfer apparatus, the transfer section has, for example, an intermediate transfer body, a first transfer section, and a second transfer section. A toner image formed on the surface of the image carrier is transferred by the first transfer section to the surface of the intermediate transfer body (first transfer). The toner image transferred to the surface of the intermediate transfer body is then transferred by the second transfer section to the surface of a recording medium (second transfer).

Part of an image forming apparatus according to this exemplary embodiment, for example a portion including the developing section, may have a cartridge structure, a structure that allows the part to be attached to and detached from the image forming apparatus (i.e., may be a process cartridge). An example of a process cartridge that may be used is one that includes a developing section used in an image forming apparatus according to this exemplary embodiment, i.e., a developing section that contains an electrostatic charge image developer that includes a specific toner.

The following describes an example of an image forming apparatus according to this exemplary embodiment. It should be noted that this is not the only example. The following description is focused on the structural elements illustrated in the drawings.

FIG. 1 schematically illustrates the structure of an image forming apparatus according to this exemplary embodiment.

The image forming apparatus illustrated in FIG. 1 includes first to fourth electrophotographic image forming units 10Y, 10M, 10C, and 10K (image forming section) that produce images in the colors of yellow (Y), magenta (M), cyan (C), and black (K), respectively, based on color-separated image data. The image forming units (hereinafter also referred to simply as "units") 10Y, 10M, 10C, and 10K are arranged in a horizontal row, spaced apart by a predetermined distance. The units 10Y, 10M, 10C, and 10K may be process cartridges that are attached to and detached from the image forming apparatus.

Above the units 10Y, 10M, 10C, and 10K, an intermediate transfer belt (example of an intermediate transfer body) 20 extends via each of the units. The intermediate transfer belt 20 is wound over a drive roller 22 and a support roller 24, both contacting the inner surface of the intermediate transfer belt 20, and runs in the direction from the first unit 10Y to the fourth unit 10K. A spring or similar mechanism not illustrated applies force to the support roller 24 to bring it away from the drive roller 22, placing tension on the intermediate transfer belt 20 wound over the two rollers. On the image carrying side of the intermediate transfer belt 20 is an intermediate transfer belt cleaning device 30 facing the drive roller 22.

The developing devices (example of a developing section) 4Y, 4M, 4C, and 4K of the units 10Y, 10M, 10C, and 10K are fed with toners in yellow, magenta, cyan, and black, respectively, contained in toner cartridges 8Y, 8M, 8C, and 8K.

The first to fourth units 10Y, 10M, 10C, and 10K are equivalent in structure and operation. In the following, the first unit 10Y, which is located upstream of the others in the direction of running of the intermediate transfer belt and forms a yellow image, is described to represent the four units.

The first unit 10Y has a photoreceptor 1Y that operates as an image carrier. Around the photoreceptor 1Y are a charging roller (example of a charging section) 2Y that charges the surface of the photoreceptor 1Y to a predetermined potential, an exposure device (example of an electrostatic charge image forming section) 3 that irradiates the charged surface with a laser beam 3Y based on a color-separated image signal to form an electrostatic charge image there, a developing device (example of a developing section) 4Y that supplies charged toner to the electrostatic charge image to develop the electrostatic charge image, a first transfer roller (example of a first transfer section) 5Y that transfers the developed toner image to the intermediate transfer belt 20, and a photoreceptor cleaning device (example of an image carrier leaning section) 6Y that removes any toner remaining on the surface of the photoreceptor 1Y after the first transfer, arranged in order.

The first transfer roller 5Y is inside the intermediate transfer belt 20 and faces the photoreceptor 1Y. The first transfer rollers 5Y, 5M, 5C, and 5K of the units are connected to bias power supplies (not illustrated) that apply a first transfer bias to the rollers. The bias power supplies change the value of the transfer bias they apply to the first transfer rollers under the control of a controller not illustrated.

The following describes how the first unit 10Y operates to form a yellow image.

First, in advance of the operations, the charging roller 2Y charges the surface of the photoreceptor 1Y to a potential of −600 V to −800 V.

The photoreceptor 1Y is a stack of a conductive (e.g., the volume resistivity at 20° C. is $1\times10^{-6}$ Ωcm or less) substrate and a photosensitive layer thereon. The photosensitive layer is highly resistant (has the typical resistance of a resin) in its normal state, but when irradiated with a laser beam, changes resistivity in the portion irradiated with the laser beam. By the characteristic of this, the charged surface of the photoreceptor 1Y is irradiated with a laser beam 3Y. The laser beam 3Y is emitted from the exposure device 3 and is based on image data for yellow sent from a controller not illustrated. This forms an electrostatic charge image for a yellow image pattern on the surface of the photoreceptor 1Y.

The electrostatic charge image is an image formed on the surface of the photoreceptor 1Y as a result of charging. The laser beam 3Y reduces the resistivity of the irradiated portion of the photosensitive layer, causing the charge on the surface of the photoreceptor 1Y to leave. The charge on the portion not irradiated with the laser beam 3Y stays. Produced in this way, the electrostatic charge image is a so-called negative latent image.

As the photoreceptor 1Y runs, the electrostatic charge image formed on the photoreceptor 1Y rotates to a predetermined developing point. At the developing point, the electrostatic charge image on the photoreceptor 1Y is visualized by being developed into a toner image by the developing device 4Y.

The developing device 4Y contains an electrostatic charge image developer that includes, for example, at least yellow toner and a carrier. The yellow toner has been stirred inside the developing device 4Y and thereby triboelectrically charged with the same polarity as the charge on the photoreceptor 1Y (negative). With this polarity of charge, the yellow toner is on a developing roller (example of a developer carrier). The passage of the surface of the photoreceptor 1Y through the developing device 4Y causes the yellow toner to electrostatically adhere to the latent image portion, from which static electricity has been removed, of the surface of the photoreceptor 1Y. As a result, the latent image is developed by the yellow toner. The photoreceptor 1Y with a yellow toner image thereon continues to be run at a predetermined speed, transporting the toner image developed thereon to a predetermined first transfer point.

On the arrival of the yellow toner image on the photoreceptor 1Y at the first transfer point, a first transfer bias is applied to the first transfer roller 5Y. Electrostatic force directed from the photoreceptor 1Y to the first transfer roller 5Y acts on the toner image, transferring the toner image on the photoreceptor 1Y to the intermediate transfer belt 20. The polarity of this transfer bias is (+), opposite the polarity of the toner (−). For the first unit 10Y, the controller (not illustrated) controls the transfer bias to, for example, +10 μA. Any residual toner on the photoreceptor 1Y is removed and collected at the photoreceptor cleaning device 6Y.

For the second unit 10M and the later units, too, the first transfer bias applied to the first transfer roller 5M, 5C, or 5K is controlled in the same way as that for the first unit.

After receiving a yellow toner image at the first unit 10Y in this way, the intermediate transfer belt 20 is moved to pass through the second unit 10M, third unit 10C, and then fourth unit 10K. Toner images in the respective colors are transferred, one laid over another (multilayer transfer).

After the multilayer transfer of toner images in four colors by the first to fourth units, the intermediate transfer belt 20 reaches a second transfer section. The second transfer section is composed of the intermediate transfer belt 20, the support roller 24, which is contacting the inner surface of the intermediate transfer belt 20, and a second-transfer roller (example of a second-transfer section) 26 on the image-carrying side of the intermediate transfer belt 20. A feeding mechanism delivers recording paper (example of a recording medium) P into the gap between the second transfer roller 26 and the intermediate transfer belt 20 in a timed manner, and a second transfer bias is applied to the support roller 24. The polarity of this transfer bias is (−), the same as the polarity of the toner (−). Electrostatic force directed from the intermediate transfer belt 20 to the recording paper P acts on the toner image, transferring the toner image on the intermediate transfer belt 20 to the recording paper P. There is a resistance detector (not illustrated) that detects the resistance of the second transfer section, and the second transfer bias is determined, or controlled, in accordance with the resistance detected by this resistance detector.

The recording paper P with a toner image thereon is sent to a section of a fixing device (example of a fixing section) 28 in which a pair of fixing rollers are pressed against each other (nip section). The toner image is fixed on the recording paper P, producing a fixed image. After the completion of the fixation of the color image, the recording paper P is transported to an ejection section to finish a series of operations for the formation of a color image.

The recording paper P, to which the toner image is transferred, may be, for example, paper for copiers, printers, etc., of electrophotographic type. The recording medium includes a recording paper P and an overhead-projector (OHP) film. The fixed image may be given a smoother finish by the use of recording paper P having a smooth surface. Examples include coated paper, which is paper whose surface has a resin or other coating, and art paper, which is high-grade coated paper for printing purposes.

Figure 2:
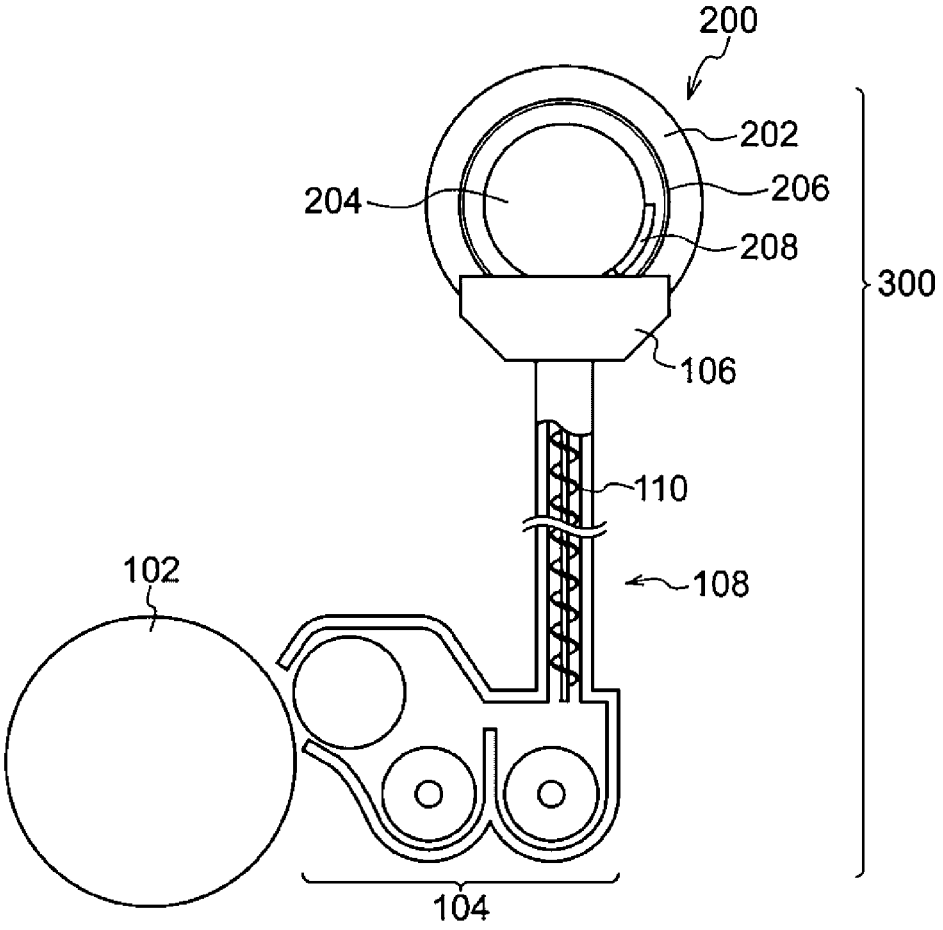
FIG. 2 schematically illustrates the structure of an example of an image carrier, a developing section, and a replenishment toner supplying section that an image forming apparatus according to this exemplary embodiment may include.

FIG. 2 schematically illustrates the structure of an example of the image carrier, developing section, and replenishment toner supplying section that an image forming apparatus according to this exemplary embodiment may include.

The exemplary structure illustrated in FIG. 2 includes a photoreceptor 102 as an example of an image carrier, a developing device 104 as an example of a developing section, and a replenishment toner supplying device 300 as an example of a replenishment toner supplying section. The replenishment toner supplying device 300 includes a toner cartridge 200 as an example of a replenishment toner cartridge and has a replenishment toner transporting route 108. The toner cartridge 200 is attachable to and detachable from the image forming apparatus. A replenishment toner cartridge mount 106 is placed at upstream side of the replenishment toner transporting route 108 in the direction of transport, as an example of a section for detachably attaching the replenishment toner cartridge to the image forming apparatus. The replenishment-toner-container mount 106 includes a toner inlet (not illustrated) opening at one end of the replenishment toner transporting route 108 in the direction of transport. The other end of the replenishment toner transporting route 108 in the direction of transport is connected to the developing device 104. An auger screw 110 is placed in the replenishment toner transporting route 108, as an example of a toner transport section.

The toner cartridge 200 contains in its inside the aforementioned specific toner as replenishment toner, toner to be supplied to the developing device 104. The toner cartridge 200 has been attached to the replenishment toner cartridge mount 106 in such a manner that the axis Q of the toner cartridge 200 is parallel with a substantially horizontal direction. The toner cartridge 200, moreover, has been attached to the replenishment toner cartridge mount 106 in such a manner that a driven cog 206 on its body 202 engages with a drive cog (not illustrated) on the replenishment toner cartridge mount 106. Attaching the toner cartridge 200 will open a shutter 208 on its cap 204. Opening the shutter 208 will expose an outlet opening in the cap 204, an opening for the replenishment toner to be ejected therethrough. This outlet is positioned to face the toner inlet of the replenishment toner transporting route 108 and is connected to the toner inlet, thereby serving as an interface to detachably attach the toner cartridge 200. As the drive cog, not illustrated, rotates, the driven cog 206 is driven to rotate, transmitting the rotation to the body 202. The body 202, attached to the replenishment toner cartridge mount 106, rotates around the axis Q of the toner cartridge 200 with the axis of rotation. The driven rotation of the body 202 causes the replenishment toner inside to be moved by the ridged portion formed inside the body 202 in the direction to the outlet from the opposite axial end of the toner cartridge 200. As a result, the replenishment toner is ejected through the outlet. The ejected replenishment toner is fed to the replenishment toner transporting route 108.

The image forming apparatus 100 includes a controller not illustrated that controls the operation of each device (section) by communicating with each device (section). For example, the replenishment toner supplying device 300 illustrated in FIG. 2 has a toner density sensor not illustrated, and if the sensor detects an insufficient toner density, the controller (not illustrated) issues a signal to turn on a motor for rotating the drive cog. Driven by the drive cog, the driven cog 206 rotates, thereby rotating the body 202 of the toner cartridge 200. The rotation of the body 202 causes the toner contained in the toner cartridge 200 to be ejected through the outlet of the toner cartridge 200 and fed to the developing device 104. To give another example, the toner cartridge 200 illustrated in FIG. 2 has a toner level sensor not illustrated inside. By the signal of the toner level sensor, the image forming apparatus 100 displays a message to replace the toner cartridge 200 on its display module, not illustrated, when the amount of toner remaining is insufficient.

The controller, not illustrated, is a computer that controls the entire apparatus and performs calculations. To be more specific, the controller in an exemplary configuration includes a CPU (central processing unit), ROM (read-only memory) in which programs are stored, RAM (random access memory) that is used as a work area when the programs are executed, nonvolatile memory in which kinds of information are stored, and an input-output interface (I/O) (all not illustrated). The CPU, ROM, RAM, nonvolatile memory, and I/O are connected to each other via buses.

Besides the controller, the image forming apparatus 100 illustrated in FIG. 1 includes, for example, a console, an image processor, image memory, a data storage, and a communication module (all not illustrated). Each of the console, image processor, image memory, data storage, and communication module is connected to the I/O of the controller. The controller, not illustrated, controls each of the console, image processor, image memory, data storage, and communication module by communicating with each module.

The developing device 104 has, for example, two rooms divided by a partition. In one room, there is the exit from the replenishment toner transporting route 108. In the other room, a developing roller faces the photoreceptor 102. Part of one room connects to part of the other, and each room includes one stirring member that transports the developer while stirring it. The developer (not illustrated) in the developing device 104 is transported and fed to the developer roller while being stirred by the two stirring members.

In the exemplary structure illustrated in FIG. 2, the replenishment toner is first fed to the replenishment toner transporting route 108, and then the auger screw 110 is operated to bring the replenishment toner through the replenishment toner transporting route 108. The replenishment toner that has passed through the replenishment toner transporting route 108 is fed to the developing device 104. The supplying of the replenishment toner to the replenishment toner transporting route 108 is achieved by the rotation of the body 202 of the toner cartridge 200 (example of a body of the replenishment toner cartridge). The rotation moves the replenishment toner contained inside the toner cartridge 200 to the outlet and sends out the replenishment toner through the outlet.

The foregoing description is about the exemplary structure illustrated in FIG. 2, but this does not mean that the replenishment toner supplying section needs to be configured as in the exemplary structure illustrated in FIG. 2. The replenishment toner supplying section in FIG. 2 includes an auger screw 110 as a toner transporter in the replenishment toner transporting route 108, but it is not the only possible toner transporter. For example, the toner may be transported by free falling or by using air.

Process Cartridge

A process cartridge is described. A process cartridge includes a developing section, a replenishment toner cartridge, and a replenishment toner supplying section and is attached to and detached from an image forming apparatus. The developing section contains an electrostatic charge image developer and develops an electrostatic charge image formed on the surface of an image carrier into a toner image using the electrostatic charge image developer. The electrostatic charge image developer includes toner, and the toner includes toner particles and satisfies the following relations: $(\ln \eta(T1)-\ln \eta(T2))/(T1-T2)$ is −0.14 or less; $(\ln \eta(T2)-\ln \eta(T3))/(T2-T3)$ is −0.15 or more; and $(\ln \eta(T2)-\ln \eta(T3))/(T2-T3)$ is greater than $(\ln \eta(T1)-\ln \eta(T2))/(T1-T2)$, where $\eta(T1)$ is the viscosity $\eta$ of the toner at T1=60° C., $\eta(T2)$ is the viscosity $\eta$ of the toner at T2=90° C., and $\eta(T3)$ is the viscosity of the toner at T3=130° C. The replenishment toner cartridge contains replenishment toner, toner to be supplied to the developing section. The replenishment toner supplying section supplies the replenishment toner to the developing section and includes the replenishment toner cartridge. The replenishment toner cartridge contains the replenishment toner, has an outlet for the replenishment toner to be ejected therethrough, and has been detachably attached to the replenishment toner supplying section with the outlet serving as an interface. Inside the body of the replenishment toner cartridge is a ridged portion by which the replenishment toner inside is moved toward the outlet as the body rotates. The replenishment toner is the aforementioned specific toner.

This is not the only possible configuration of the process cartridge. For example, the process cartridge may further include at least one selected from other sections such as an image carrier, a charging section, an electrostatic-charge-image-forming section, and a transfer section.

Replenishment Toner Cartridge

Next is described a replenishment toner cartridge according to this exemplary embodiment.

A replenishment toner cartridge according to this exemplary embodiment is one that contains replenishment toner and is attached to and detached from an image forming apparatus. The replenishment toner cartridge contains replenishment toner, toner intended to be supplied to a developing section present inside the image forming apparatus.

In more specific terms, a replenishment toner cartridge according to this exemplary embodiment contains replenishment toner, has an axis of the rotation of the replenishment toner cartridge, includes a cap, and also includes a ridged portion. The replenishment toner is a toner that includes toner particles and satisfies the following relations: $(\ln \eta(T1)-\ln \eta(T2))/(T1-T2)$ is −0.14 or less; $(\ln \eta(T2)-\ln \eta(T3))/(T2-T3)$ is −0.15 or more; and $(\ln \eta(T2)-\ln \eta(T3))/(T2-T3)$ is greater than $(\ln \eta(T1)-\ln \eta(T2))/(T1-T2)$, where $\eta(T1)$ is the viscosity $\eta$ of the toner at T1=60° C., $\eta(T2)$ is the viscosity $\eta$ of the toner at T2=90° C., and $\eta(T3)$ is the viscosity of the toner at T3=130° C. The cap is at the axial end of the replenishment toner cartridge and has an outlet for the replenishment toner to be ejected therethrough. The ridged portion is inside the body of the replenishment toner cartridge. As the body rotates, the replenishment toner inside is moved by the ridged portion in the direction from the other axial end of the replenishment toner cartridge toward the outlet. The replenishment toner cartridge is attached to and detached from an image forming apparatus with the outlet serving as an interface.

The image forming apparatus illustrated in FIG. 1 is one configured so that toner cartridges 8Y, 8M, 8C, and 8K as an example of replenishment toner cartridges are attached thereto and detached therefrom. The developing devices 4Y, 4M, 4C, and 4K are connected to the toner cartridges for their respective colors by replenishment toner transporting routes not illustrated. When there is little toner in a toner cartridge, this toner cartridge is replaced. The replenishment toner supplying section having toner cartridges and replenishment toner transporting routes not illustrated may be, for example, replenishment toner supplying devices 300 as in the exemplary structure illustrated in FIG. 2, one of which is described above as an example of a replenishment toner supplying section.

Figure 3:
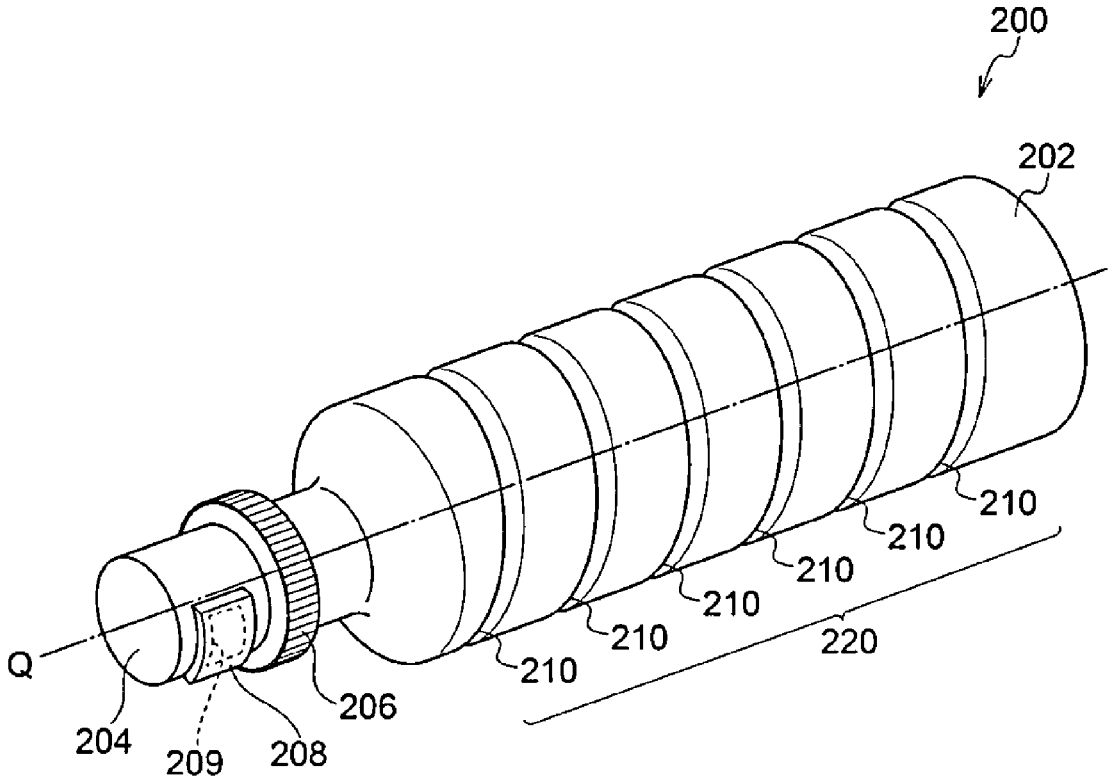
FIG. 3 schematically illustrates the structure of an example of a replenishment toner cartridge according to this exemplary embodiment.

FIG. 3 schematically illustrates the structure of an example of a replenishment toner cartridge according to this exemplary embodiment. In the toner cartridge 200 illustrated in FIG. 3, illustrated as an example of a replenishment toner cartridge, a specific toner is contained as replenishment toner. The toner cartridge 200, moreover, is attached to and detached from an image forming apparatus, for example the image forming apparatus 100 illustrated in FIG. 1, with the outlet 209 of the toner cartridge 200 serving as an interface.

The toner cartridge 200 has an outlet 209 at a first end in the direction of the axis Q of the rotation of the toner cartridge 200 for the replenishment toner to be ejected therethrough. Inside the body 202 is a ridged portion 220. The protrusions 210 in the ridged portion 220 are raised when viewed from the inside of the body 202. The portions between protrusions 210 adjacent in the direction of the axis Q are sunken when viewed from the inside of the body 202. As the body 202 rotates, the ridged portion 220 moves the replenishment toner inside toward the outlet 209. The ridged portion 220 is shaped like a spiral winding around the axis Q of the toner cartridge 200, extending in the direction from a axial end to the outlet 209. In the ridged portion 220, moreover, the width of each protrusion 210, or length in the direction of the axis Q, is smaller than the distance between adjacent protrusions 210 to support the replenishment toner move toward the outlet 209 of the toner cartridge 200.

The toner cartridge 200 illustrated in FIG. 3, illustrated as an example of a replenishment toner cartridge, includes a body 202 and a cap 204. The cap 204 has a driven cog 206, which is driven by the rotation of a drive cog, and a shutter 208, which is used to close and open the outlet 209. The driven cog 206 is concentric with the body 202 and has an outer diameter smaller than that of the body 202. The cap 204 is at the first end in the direction of the axis Q of the toner cartridge 200. The shutter 208 is on the lateral side of the cap 204, and opening and closing the shutter 208 on the cap 204 will open and close the outlet (not illustrated).

The body 202 is made of a resin. For example, the body 202 may contain a polyester, polyolefin, or similar resin as a constituent material. The body 202 illustrated in FIG. 3 is integral with the driven cog 206. The body 202 in an exemplary configuration may be produced by preparing a preform as an example of an intermediate from at least one resin that includes at least one polyester (e.g., polyethylene terephthalate) or at least one polyolefin (e.g., at least one of polyethylene and polypropylene) by injection molding and then shaping the preform by blow molding.

The foregoing description is about the toner cartridge 200 illustrated in FIG. 3 as an example of a replenishment toner cartridge according to this exemplary embodiment, but this does not mean that the replenishment toner cartridge needs to be configured as in the exemplary structure illustrated in FIG. 3. Any configuration is possible as long as inadequate supply of replenishment toner is reduced.

For example, the shutter 208, used to open and close the outlet, does not need to be on the lateral side of the cap 204 but may be anywhere of the cap 204. The cap 204 may have a handle with which the cap 204 can be rotated. In such a configuration, the handle is turned to rotate the cap 204, the rotation of the cap 204 will open the shutter 208 by moving it in the direction of the circumference of the cap 204, and, as a result, the outlet (not illustrated) is exposed.

The outer diameter of the driven cog 206 may be equal to that of the body 202 or larger than that of the body 202. The driven cog 206 does not need to be integral with the body 202. For example, the driven cog 206 and the body 202 may be prepared as separate sections and then combined together.

The width of each protrusion 210, or length in the direction of the axis Q, may be equal to the distance between adjacent protrusions 210. The width of each protrusion 210, or length in the direction of the axis Q, may even be larger than the distance between adjacent protrusions 210. In this case, the ridged portion is grooved when viewed from the inside of the body 202.

The body 202 may have an opening for toner loading (not illustrated) at its bottom (at the second end in the direction of the axis Q of the toner cartridge 200, or the end opposite the cap 204, which is located at the first end). In such a configuration, a seal that can be used to open and close the opening for loading is detachably attached to the bottom.

Electrostatic-Charge-Image Developer

Next is described the electrostatic-charge-image developer contained in the developing section of an image forming apparatus according to this exemplary embodiment.

An electrostatic-charge-image developer according to this exemplary embodiment includes at least a specific toner. The electrostatic-charge-image developer may be a one-component developer, which is substantially a specific toner, or may be a two-component developer, which includes a specific toner and a carrier.

Toner for Electrostatic Charge Image Development

A specific toner includes toner particles and optionally external additives.

Temperature and Viscosity Parameters of the Toner

The specific toner satisfies the following relations:

$$(\ln \eta(T1)-\ln \eta(T2))/(T1-T2)\leq -0.14;$$

$$(\ln \eta(T2)-\ln \eta(T3))/(T2-T3)\geq -0.15; \text{ and}$$

$$(\ln \eta(T1)-\ln \eta(T2))/(T1-T2)<(\ln \eta(T2)-\ln \eta(T3))/(T2-T3),$$

where η(T1) represents the viscosity of the specific toner at 60° C., η(T2) represents the viscosity of the specific toner at 90° C., and η(T3) represents the viscosity of the specific toner at 130° C.

The expression "ln η(T1)" herein represents the natural logarithm of the viscosity η of the toner at T1=60° C.

Viscosity values of a toner herein have a unit of Pa·s unless stated otherwise.

These viscosity values at certain temperatures of a toner in this exemplary embodiment are measurements obtained as follows.

Viscosity values of a toner in this exemplary embodiment are determined by performing a temperature elevation test using a plate rheometer (RDA2 RHIOS system ver. 4.3, produced by Rheometric Scientific Ld.). In the test, an approximately 0.3-g sample of the toner placed between 8-mm parallel plates is heated from approximately 30° C. to approximately 150° C. at a temperature elevation rate of 1° C./min under a 20% or less distortion at a frequency of 1 Hz.

The (ln η(T1)−ln η(T2))/(T1−T2) as a parameter of the specific toner is −0.14 or less. It may be −0.16 or less, preferably −0.30 or more and −0.18 or less, more preferably −0.25 or more and −0.20 or less in view of the reduction of inadequate supply of replenishment toner.

The (ln η(T2)−ln η(T3))/(T2−T3) as a parameter of the specific toner is −0.15 or more. It may be more than −0.14, preferably −0.13 or more, more preferably −0.12 or more and −0.03 or less, in particular −0.11 or more and −0.05 or less in view of the reduction of inadequate supply of replenishment toner.

Moreover, the (ln η(T2)−ln η(T3))/(T2−T3) of the specific toner is larger than the (ln η(T1)−ln η(T2))/(T1−T2) of the specific toner. The {(ln η(T2)−ln η(T3))/(T2−T3)}−{(ln η(T1)−ln η(T2))/(T1−T2)} may be 0.01 or more, preferably 0.05 or more and 0.5 or less, in particular 0.08 or more and 0.2 or less in view of the reduction of inadequate supply of replenishment toner.

The specific toner, moreover, may have a (ln η(T0)−ln η(T1))/(T0−T1), where η(T0) represents the viscosity η of the toner at T0=40° C., of −0.12 or more and greater than the (ln η(T1)−ln η(T2))/(T1−T2).

The specific toner becomes more effective in reducing inadequate supply of replenishment toner when it has a (ln η(T0)−ln η(T1))/(T0−T1) of −0.12 or more. The (ln η(T0)−ln η(T1))/(T0−T1) may be −0.05 or less, in particular −0.11 or more and −0.06 or less.

The specific toner, moreover, becomes more effective in reducing inadequate supply of replenishment toner when its (ln η(T0)−ln η(T1))/(T0−T1) is greater than its (ln η(T1)−ln η(T2))/(T1−T2). The {(ln η(T0)−ln η(T1))/(T0−T1)}−{(ln η(T1)−ln η(T2))/(T1−T2)} may be 0.01 or more, preferably 0.05 or more and 0.5 or less, in particular 0.08 or more and 0.2 or less.

It should be noted that these temperature and viscosity parameters ln η(T1)−ln η(T2))/(T1−T2), (ln η(T2)−ln η(T3))/(T2−T3), and (ln η(T0)−ln η(T1))/(T0−T1) of the toner may be controlled to be within the above ranges by any method. An example is to adjust the molecular weight of the binder resin in the toner particles, more specifically the molecular weights and percentages of the low-molecular-weight and high-molecular-weight components of the binder resin. If the toner particles are produced by the undermentioned aggregation and coalescence approach, these parameters may alternatively be controlled by adjusting the degree of aggregation, for example by changing the amount of flocculant.

The η(T0), η(T1), η(T2), and η(T3) of the specific toner, which are the viscosity values of the toner at T0=40° C., T1=60° C., T2=90° C., and T3=130° C., respectively, may be respectively within the following ranges in view of the reduction of inadequate supply of replenishment toner.

- η(T0): $1.0\times10^{7}$ or more and $1.0\times10^{9}$ or less (preferably $2.0\times10^{7}$ or more and $5.0\times10^{8}$ or less)
- η(T1): $1.0\times10^{5}$ or more and $1.0\times10^{8}$ or less (preferably $1.0\times10^{6}$ or more and $5.0\times10^{7}$ or less)
- η(T2): $1.0\times10^{3}$ or more and $1.0\times10^{5}$ or less (preferably $5.0\times10^{3}$ or more and $5.0\times10^{4}$ or less)
- η(T3): $1.0\times10^{2}$ or more and $1.0\times10^{4}$ or less (preferably $1.0\times10^{2}$ or more and $5.0\times10^{3}$ or less)

Highest-Endothermic-Peak Temperature of the Toner

The highest-endothermic-peak temperature of the specific toner may be 70° C. or more and 100° C. or less, preferably 75° C. or more and 95° C. or less, in particular 83° C. or more and 93° C. or less.

Here, the highest-endothermic-peak temperature of a specific toner is defined as the temperature at which the toner's differential scanning calorimetry (DSC) endothermic curve measured over the range of at least −30° C. to 150° C. has its highest peak.

A method that may be used to measure the highest-endothermic-peak temperature of a specific toner is as follows.

The measuring instrument is PerkinElmer DCS-7 differential scanning calorimeter. The temperature calibration of the colorimeter's detector is based on the melting point of indium and zinc, and the enthalpy calibration is based on the melting enthalpy of indium. An aluminum pan with a sample therein and a control empty pan are heated from room temperature to 150° C. at a temperature elevation rate of 10° C./min, cooled from 150° C. to −30° C. at a rate of 10° C./min, and then heated from −30° C. to 150° C. at a rate of 10° C./min. The temperature at which the largest endothermic peak is observed in the second run of heating is the highest-endothermic-peak temperature.

Infrared Absorption Spectrum of the Toner Particles

If the specific toner contains the undermentioned amorphous polyester resin as a binder resin, it may be that in an infrared absorption (IR) spectrum of the toner particles, the ratio of the absorbance at a wavenumber of 1,500 $cm^{-1}$ to that at 720 $cm^{-1}$ (absorbance at 1,500 $cm^{-1}$/absorbance at 720 $cm^{-1}$) is 0.6 or less, and, at the same time, the ratio of the absorbance at a wavenumber of 820 $cm^{-1}$ to that at 720 $cm^{-1}$ (absorbance at 820 $cm^{-1}$/absorbance at 720 $cm^{-1}$) is 0.4 or less in view of the reduction of inadequate supply of replenishment toner. Preferably, in an IR spectrum of the toner particles, the ratio of the absorbance at a wavenumber of 1,500 $cm^{-1}$ to that at 720 $cm^{-1}$ is 0.4 or less with the ratio of the absorbance at a wavenumber of 820 $cm^{-1}$ to that at 720 $cm^{-1}$ being 0.2 or less. It is more preferred that in an IR spectrum of the toner particles, the ratio of the absorbance at a wavenumber of 1,500 $cm^{-1}$ to that at 720 $cm^{-1}$ be 0.2 or more and 0.4 or less with the ratio of the absorbance at a wavenumber of 820 $cm^{-1}$ to that at 720 $cm^{-1}$ being 0.05 or more and 0.2 or less.

These IR absorbance values at certain wavenumbers in this exemplary embodiment are measured as follows. First, the toner particles of interest (after the removal of any external additive from the toner) are made into a sample for measurement by KBr tableting. This sample for measurement is analyzed using an IR spectrophotometer (JASCO FT-IR-410) at wavenumbers between 500 $cm^{-1}$ and 4,000 $cm^{-1}$ under the conditions of 300 scans and a resolution of 4 $cm^{-1}$. Then baseline correction is performed, for example in an offset, a spectral portion with no absorption, to determine the absorbance values at the wavenumbers.

The specific toner, moreover, may be such that in an IR spectrum of the toner particles, the ratio of the absorbance at a wavenumber of 1,500 $cm^{-1}$ to that at 720 $cm^{-1}$ may be 0.6 or less, preferably 0.4 or less, more preferably 0.2 or more and 0.4 or less, in particular 0.3 or more and 0.4 or less in view of the reduction of inadequate supply of replenishment toner.

Likewise, the specific toner may be such that in an IR spectrum of the toner particles, the ratio of the absorbance at a wavenumber of 820 $cm^{-1}$ to that at 720 $cm^{-1}$ may be 0.4 or less, preferably 0.2 or less, more preferably 0.05 or more and 0.2 or less, in particular 0.08 or more and 0.2 or less in view of the reduction of inadequate supply of replenishment toner.

Toner Particles

The toner particles contain, for example, a binder resin and optionally a coloring agent, a release agent, and/or other additives. Preferably, the toner particles contain a binder resin and a release agent.

In this exemplary embodiment, the toner particles may be of any kind. Examples include particles such as of a yellow, magenta, cyan, or black toner and even include white toner particles, transparent toner particles, and glossy toner particles.

Binder Resin

The binder resin may be, for example, a vinyl resin. The vinyl resin may be a homopolymer of a monomer or a copolymer of two or more monomers, and examples of monomers include styrenes (e.g., styrene, p-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene).

Alternatively, the binder resin may be, for example, a non-vinyl resin, such as an epoxy resin, polyester resin, polyurethane resin, polyamide resin, cellulose resin, polyether resin, or modified rosin, a mixture of any of these resins and the aforementioned vinyl resin, or a graft copolymer obtained by copolymerizing a vinyl monomer in the presence of any of these non-vinyl resins.

One of these binder resins may be used alone, or two or more may be used in combination.

The binder resin(s) may include at least one selected from the group consisting of a styrene-acrylic resin and an amorphous polyester resin, preferably one of a styrene-acrylic resin and an amorphous polyester resin, in view of the reduction of inadequate supply of replenishment toner. It is more preferred that the percentage of the styrene-acrylic resin or amorphous polyester resin to the total mass of binder resins in the toner be 50% by mass or more, in particular 80% by mass or more.

A styrene-acrylic resin gives the specific toner strength and stability during storage if contained as a binder resin.

An amorphous polyester resin has good fixation at low temperatures if contained in the specific toner as a binder resin.

The amorphous polyester resin may be one that has no bisphenol structure in view of the reduction of inadequate supply of replenishment toner and also of fixation.

(1) Styrene-Acrylic Resin

An Example of a Binder Resin is a Styrene-Acrylic Resin.

A styrene-acrylic resin is a copolymer of at least a styrene monomer (monomer having the styrene structure) and a (meth)acrylic monomer (monomer having a (meth)acrylic group, preferably a (meth)acryloxy group). Copolymers of, for example, a styrene monomer and any of the aforementioned (meth)acrylate monomers are also examples of styrene-acrylic resins.

It is to be noted that the acrylic resin segment of a styrene-acrylic resin is a moiety resulting from the polymerization of an acrylic monomer, a methacrylic monomer, or both. The expression "(meth)acrylic" is intended to represent both "acrylic" and "methacrylic."

Specific examples of styrene monomers include styrene, alkylated styrenes (e.g., α-methylstyrene, 2-methylstyrene, 3-methylstyrene, 4-methylstyrene, 2-ethylstyrene, 3-ethylstyrene, and 4-ethylstyrene), halogenated styrenes (e.g., 2-chlorostyrene, 3-chlorostyrene, and 4-chlorostyrene), and vinylnaphthalene. One styrene monomer may be used alone, or two or more may be used in combination.

Of these styrene monomers, styrene is preferred by the characteristic of its high reactivity, ready availability, and ease of control of the reaction involving it.

Specific examples of (meth)acrylic monomers include (meth)acrylic acid and (meth)acrylates. Examples of (meth) acrylates include alkyl (meth)acrylates (e.g., methyl (meth) acrylate, ethyl (meth)acrylate, n-propyl (meth)acrylate, n-butyl (meth)acrylate, n-pentyl (meth)acrylate, n-hexyl acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethylhexyl (meth) acrylate, cyclohexyl (meth)acrylate, and t-butylcyclohexyl (meth)acrylate), aryl (meth)acrylates (e.g., phenyl (meth) acrylate, biphenyl (meth)acrylate, diphenylethyl (meth) acrylate, t-butylphenyl (meth)acrylate, and terphenyl (meth) acrylate), dimethylaminoethyl (meth)acrylate, diethylaminoethyl (meth)acrylate, methoxyethyl (meth) acrylate, 2-hydroxyethyl (meth)acrylate, β-carboxyethyl (meth)acrylate, and (meth)acrylamides. One (meth)acrylic monomer may be used alone, or two or more may be used in combination.

Of these (meth)acrylates as (meth)acrylic monomers, those (meth)acrylates that have a C2-14 (preferably C2-10, more preferably C3-8) alkyl group are preferred because they provide better fixation of the toner.

n-Butyl (meth)acrylate is particularly preferred. In particular, n-butyl acrylate is preferred.

The copolymer may contain styrene monomers and (meth)acrylic monomers in any ratio (by mass, styrene monomers/(meth)acrylic monomers). For example, the ratio of the two types of monomers in the copolymer may be between 85/15 to 70/30.

The styrene-acrylic resin may have a crosslink structure in view of the reduction of inadequate supply of replenishment toner. An example of a crosslinked styrene-acrylic resin is a copolymer of at least a styrene monomer, a (meth)acrylic monomer, and a crosslinking monomer.

The crosslinking monomer may be, for example, a crosslinking agent that has two or more functional groups.

Examples of bifunctional crosslinking agents include divinyl benzene, divinyl naphthalene, di(meth)acrylate compounds (e.g., diethylene glycol di(meth)acrylate, methylene bis(meth)acrylamide, decanediol diacrylate, and glycidyl (meth)acrylate), polyester-forming di(meth)acrylates, and 2-([1'-methylpropylideneamino]carboxyamino)ethyl methacrylate.

Examples of multifunctional crosslinking agents include tri(meth)acrylate compounds (e.g., pentaerythritol tri(meth) acrylate, trimethylolethane tri(meth)acrylate, and trimethylolpropane tri(meth)acrylate), tetra(meth)acrylate compounds (e.g., pentaerythritol tetra(meth)acrylate and oligoester (meth)acrylates), 2,2-bis(4-methacryloxy, polyethoxyphenyl)propane, diallyl phthalate, triallyl cyanurate, triallyl isocyanurate, triallyl trimellitate, and diaryl chlorendate.

Preferably, the crosslinking monomer is a (meth)acrylate compound that has two or more functional groups in view of the reduction of inadequate supply of replenishment toner and also of fixation. It is more preferred that the crosslinking agent be a bifunctional (meth)acrylate compound, even more preferably a bifunctional (meth)acrylate that has a C6-20 alkylene group, in particular a bifunctional (meth) acrylate that has a linear C6-20 alkylene group.

The copolymer may contain crosslinking monomers in any ratio to all monomers (by mass, crosslinking monomers/all monomers). For example, the ratio of crosslinking monomers to all monomers may be between 2/1,000 and 20/1,000.

The glass transition temperature (Tg) of the styrene-acrylic resin may be 40° C. or more and 75° C. or less, preferably 50° C. or more and 65° C. or less, in view of fixation.

This glass transition temperature is that determined from the resin's DSC curve, which is obtained by differential scanning calorimetry (DSC). More specifically, this glass transition temperature is the resin's "extrapolated initial temperature of glass transition" as in the methods for determining glass transition temperatures set forth in JIS K 7121-1987 "Testing Methods for Transition Temperatures of Plastics."

The weight-average molecular weight of the styrene-acrylic resin may be 5,000 or more and 200,000 or less, preferably 10,000 or more and 100,000 or less, in particular 20,000 or more and 80,000 or less, in view of stability during storage.

The production of the styrene-acrylic resin may be by any method. A wide variety of polymerization techniques (solution polymerization, precipitation polymerization, suspension polymerization, bulk polymerization, emulsion polymerization, etc.) may be used, and the polymerization reactions may be done by any process (batch, semicontinuous, continuous, etc.).

(2) Polyester Resin

A polyester resin is also an example of a binder resin.

The polyester resin may be, for example, a known amorphous polyester resin. It is also possible to use a crystalline polyester resin in combination with an amorphous polyester resin. In that case, the percentage of the crystalline polyester resin may be, for example, 2% by mass or more and 40% by mass or less (preferably 2% by mass or more and 20% by mass or less) with respect to all binder resins.

If a resin is "crystalline" herein, it means that the resin exhibits not stepwise changes in heat absorption but a clear endothermic peak when analyzed by differential scanning calorimetry (DSC). To be more specific, being "crystalline" herein means that the half width of the endothermic peak as measured at a temperature elevation rate of 10 (° C./min) is 10° C. or narrower.

Meanwhile, if a resin is "amorphous" herein, it means that in DSC, the above half width is broader than 10° C., the resin exhibits stepwise changes in heat absorption, or the endothermic peak is not clear.

Amorphous Polyester Resin

The amorphous polyester resin may be, for example, a polycondensate of a polycarboxylic acid and a polyhydric alcohol. The amorphous polyester resin may be a commercially available one or may be a synthesized one.

Examples of polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), and anhydrides or lower-alkyl (e.g., C1-5 alkyl) esters of these acids. Of these polycarboxylic acids, aromatic dicarboxylic acids, for example, are preferred.

For polycarboxylic acids, it is also possible to use a dicarboxylic acid in combination with a crosslinked or branched carboxylic acid that has three or more carboxylic groups. Examples of carboxylic acids that have three or more carboxylic groups include trimellitic acid, pyromellitic acid, and anhydrides or lower-alkyl (e.g., C1-5 alkyl) esters of these acids.

One polycarboxylic acid may be used alone, or two or more may be used in combination.

Examples of polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Of these polyhydric alcohols, aromatic diols and alicyclic diols, for example, are preferred, and aromatic diols are more preferred.

For polyhydric alcohols, it is also possible to use a diol in combination with a crosslinked or branched polyhydric alcohol that has three or more hydroxyl groups. Examples of polyhydric alcohols that have three or more hydroxyl groups include glycerol, trimethylolpropane, and pentaerythritol.

One polyhydric alcohol may be used alone, or two or more may be used in combination.

The glass transition temperature (Tg) of the amorphous polyester resin may be 50° C. or more and 80° C. or less, preferably 50° C. or more and 65° C. or less.

This glass transition temperature is that determined from the resin's DSC curve, which is obtained by differential scanning calorimetry (DSC). More specifically, this glass transition temperature is the resin's "extrapolated initial temperature of glass transition" as in the methods for determining glass transition temperatures set forth in JIS K 7121–1987 "Testing Methods for Transition Temperatures of Plastics."

The weight-average molecular weight (Mw) of the amorphous polyester resin may be 5000 or more and 1000000 or less, preferably 7000 or more and 500000 or less.

The number-average molecular weight (Mn) of the amorphous polyester resin may be 2000 or more and 100000 or less.

The molecular weight distribution Mw/Mn of the amorphous polyester resin may be 1.5 or more and 100 or less, preferably 2 or more and 60 or less.

These weight- and number-average molecular weights are those measured by gel permeation chromatography (GPC). By GPC, the resin is analyzed using HLC-8120GPC, a GPC system from Tosoh, and Tosoh TSKgel SuperHM-M column (15 cm) with the eluate tetrahydrofuran (THF). Comparing the measured data with a molecular-weight calibration curve prepared using monodisperse polystyrene standards gives the weight- and number-average molecular weights.

The production of the amorphous polyester resin may be by a known method. To be more specific, the amorphous polyester resin may be obtained by, for example, polymerizing starting monomers by condensation polymerization at a temperature of 180° C. or more and 230° C. or less, optionally under reduced pressure so that the water and alcohol as condensation by-products will be removed.

If the starting monomers do not dissolve or are not compatible with each other at the reaction temperature, a high-boiling-point solvent as a solubilizer may be added to help them dissolve. In that case, the solubilizer is removed by distillation during the polycondensation. If the copolymerization involves a monomer that is incompatible with the reaction system, this monomer may be first condensed with an acid or alcohol planned to participate in the polycondensation and then subjected to polycondensation with the remaining ingredient(s).

Crystalline Polyester Resin

The crystalline polyester resin may be, for example, a polycondensate of a polycarboxylic acid and a polyhydric alcohol. The crystalline polyester resin may be a commercially available one or may be a synthesized one.

The crystalline polyester resin may be a polycondensate made using polymerizable monomers having a linear aliphatic structure, rather than an aromatic structure. This helps the resin form its crystal structure.

Examples of polycarboxylic acids include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids, such as phthalic acid, isophthalic acid, terephthalic acid, and naphthalene-2,6-dicarboxylic acid), and anhydrides or lower-alkyl (e.g., C1-5 alkyl) esters of these acids.

For polycarboxylic acids, it is also possible to use a dicarboxylic acid in combination with a crosslinked or branched carboxylic acid that has three or more carboxylic groups. Examples of carboxylic acids that have three or more carboxylic groups include aromatic carboxylic acids (e.g., 1,2,3-benzenetricarboxylic acid, 1,2,4-benzenetricarboxylic acid, and 1,2,4-naphthalenetricarboxylic acid) and anhydrides or lower-alkyl (e.g., C1-5 alkyl) esters of these acids.

Moreover, it is possible to use any of the above carboxylic acids with a dicarboxylic acid that has a sulfonic acid group and/or a dicarboxylic acid that has an ethylenic double bond.

One polycarboxylic acid may be used alone, or two or more may be used in combination.

Examples of polyhydric alcohols include aliphatic diols (e.g., C7-20 linear aliphatic diols). Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Of these aliphatic diols, 1,8-octanediol, 1,9-nonanediol, and 1,10-decanediol are preferred.

For polyhydric alcohols, it is also possible to use a diol in combination with a crosslinked or branched alcohol that has three or more hydroxyl groups. Examples of alcohols that have three or more hydroxyl groups include glycerol, trimethylolethane, trimethylolpropane, and pentaerythritol.

One polyhydric alcohol may be used alone, or two or more may be used in combination.

For polyhydric alcohols, the percentage of aliphatic diols may be 80 mol % or more, preferably 90 mol % or more.

The melting temperature of the crystalline polyester resin may be 50° C. or more and 100° C. or less, preferably 55° C. or more and 90° C. or less, more preferably 60° C. or more and 85° C. or less.

This melting temperature is the resin's "peak melting temperature" as in the methods for determining melting temperatures set forth in JIS K7121-1987 "Testing Methods for Transition Temperatures of Plastics" and is determined from the resin's DSC curve, which is obtained by differential scanning calorimetry (DSC).

The weight-average molecular weight (Mw) of the crystalline polyester resin may be 6,000 or more and 35,000 or less.

The production of the crystalline polyester resin may be by a known method. For example, the crystalline polyester resin may be produced in the same way as the amorphous polyester resin.

The amount of the binder resin(s) may be, for example, 40% by mass or more and 95% by mass or less, preferably 50% by mass or more and 90% by mass or less, more preferably 60% by mass or more and 85% by mass or less of the total mass of the toner particles.

If the toner particles are white toner particles, the percentage of the binder resin(s) may be 30% by mass or more and 85% by mass or less, preferably 40% by mass or more and 60% by mass or less of the total mass of the white toner particles.

Coloring Agent

Examples of coloring agents include pigments, such as carbon black, chrome yellow, Hansa yellow, benzidine yellow, threne yellow, quinoline yellow, pigment yellow, permanent orange GTR, pyrazolone orange, Vulcan orange, Watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, Calco oil blue, methylene blue chloride, phthalocyanine blue, pigment blue, phthalocyanine green, malachite green oxalate, titanium oxide, zinc oxide, calcium carbonate, basic lead carbonate, a zinc sulfide-barium sulfate mixture, zinc sulfide, silicon dioxide, and aluminum oxide, and dyes, such as acridine, xanthene, azo, benzoquinone, azine, anthraquinone, thioindigo, dioxazine, thiazine, azomethine, indigo, phthalocyanine, aniline black, polymethine, triphenylmethane, diphenylmethane, and thiazole dyes.

If the toner particles are white toner particles, the coloring agent is a white pigment.

The white pigment may be titanium oxide or zinc oxide, preferably titanium oxide.

One coloring agent may be used alone, or two or more may be used in combination.

The coloring agent(s) may optionally be surface-treated one(s) and may be used in combination with a dispersant. Moreover, multiple coloring agents may be used in combination.

The amount of the coloring agent(s) may be 1% by mass or more and 30% by mass or less, preferably 3% by mass or more and 15% by mass or less of the total mass of the toner particles.

If the toner particles are white toner particles, the amount of the white pigment(s) may be 15% by mass or more and 70% by mass or less, preferably 20% by mass or more and 60% by mass or less, of the total mass of the white toner particles.

Release Agent

Examples of release agents include, but are not limited to, hydrocarbon waxes; natural waxes, such as carnauba wax, rice wax, and candelilla wax; synthesized or mineral/petroleum waxes, such as montan wax; and ester waxes, such as fatty acid esters and montanates.

The melting temperature of the release agent may be 50° C. or more and 110° C. or less, preferably 70° C. or more and 100° C. or less, more preferably 75° C. or more and 95° C. or less, in particular 83° C. or more and 93° C. or less, in view of the reduction of inadequate supply of replenishment toner.

This melting temperature is the agent's "peak melting temperature" as in the methods for determining melting temperatures set forth in JIS K 7121-1987 "Testing Methods for Transition Temperatures of Plastics" and is determined from the agent's DSC curve, which is obtained by differential scanning calorimetry (DSC).

The toner particles in the specific toner may satisfy the relation $1.0<a/b<8.0$, where a and b are the numbers of the release agent with an aspect ratio of 5 or more and smaller than 5, respectively, in the toner particles, in view of the reduction of inadequate supply of replenishment toner. Preferably, the toner particles satisfy the relation $2.0<a/b<7.0$, in particular $3.0<a/b<6.0$.

The toner particles in the specific toner, moreover, may satisfy the relation $1.0<c/d<4.0$, where c and d are the areas of the release agent with an aspect ratio of 5 or more and smaller than 5, respectively, in the toner particles, in view of the reduction of inadequate supply of replenishment toner. Preferably, the toner particles satisfy the relation $1.5<c/d<3.5$, in particular $2.0<c/d<3.0$.

The measurement of the aspect ratio of the release agent in the toner particles is as follows.

The toner is mixed into an epoxy resin, and the epoxy resin is solidified. The resulting solid is sliced using an ultramicrotome (Leica Ultracut UCT) to give a thin section with a thickness of 80 nm or more and 130 nm or less as a sample. The thin-section sample is stained with ruthenium tetroxide for 3 hours in a desiccator at 30° C. The stained thin-section sample is imaged by scanning electron microscopy (SEM) using an ultrahigh-resolution field-emission scanning electron microscope (FE-SEM) (e.g., S-4800 from Hitachi High-Technologies Corp.). Release agents are generally stained more heavily than binder resins with ruthenium tetroxide, so the release agent is identified by shades of color caused by the degree of staining. If it is difficult to distinguish between the shades, for example because of the condition of the sample, the duration of staining is adjusted. Size may also provide the basis for identifying the release agent. In a cross-section of a toner particle, the coloring-agent domain is usually smaller than the release-agent domain.

The SEM image includes cross-sections of toner particles of various sizes. From these cross-sections, those having a diameter of 85% or more of the volume-average diameter of the toner particles are selected, and 100 of them are randomly selected and observed. Here, the diameter of a cross-section of a toner particle is defined as the longest distance between any two points on the outline of the cross-section (so-called major axis).

Each of the 100 cross-sections of toner particles selected in the SEM image is analyzed using image analysis software (WinROOF produced by Mitani Corp.) under the condition of 0.010000 μm/pixel. The image analysis visualizes the cross-sections of toner particles by displaying the embedding epoxy resin and the binder resin(s) in the toner particles with different levels of brightness (with a contrast therebetween). On the visualized image, the major axis and the aforementioned ratio (major axis/minor axis) and area of the release-agent domains in the toner particles can be determined.

The adjustment of the aspect ratio of the release agent in the toner particles may be done by several methods. For example, the toner may be maintained near the freezing point of the release agent for a certain period of time during cooling so that crystal growth will take place, or two or more release agents with different melting temperatures may be used to accelerate crystal growth during cooling.

The amount of the release agent(s) may be, for example, 1% by mass or more and 20% by mass or less, preferably 5% by mass or more and 15% by mass or less of the total mass of the toner particles.

Other Additives

Examples of other additives include magnetic substances, charge control agents, inorganic powders, and other known additives. These additives, if used, are contained in the toner particles as internal additives.

Characteristics and Other Details of the Toner Particles

The toner particles may be single-layer toner particles or may be so-called core-shell toner particles, i.e., toner particles formed by a core section (core particle) and a coating layer that covers the core section (shell layer).

The core-shell toner particles may be formed by, for example, a core section that includes a binder resin and optionally additives, such as a coloring agent and/or a release agent, and a coating layer that includes a binder resin.

The volume-average diameter (D50v) of the toner particles may be 2 μm or more and 10 μm or less, preferably 4 μm or more and 8 μm or less.

The volume-average diameter of the toner particles is that measured using a Coulter Multisizer II (Beckman Coulter) and an ISOTON-II electrolyte (Beckman Coulter).

The measurement is as follows. A sample for measurement weighing 0.5 mg or more and 50 mg or less is added to 2 ml of a 5% by mass aqueous solution of a surfactant (e.g., a sodium alkylbenzene sulfonate) as a dispersant. The resulting dispersion is added to 100 ml or more and 150 ml or less of the electrolyte.

With the sample suspended therein, the electrolyte is sonicated for 1 minute using a sonicator. The resulting dispersion is analyzed using Coulter Multisizer II with an aperture size of 100 μm to determine the particle size distribution of those particles that are 2 μm or more and 60 μm or less across. The number of particles sampled is 50000.

The determined particle size distribution is divided into segments by particle size (channels), and the cumulative distribution of volume is plotted starting from the smallest diameter. The particle diameter at which the cumulative volume is 50% is defined as the volume-average diameter D50v.

The toner particles may have any average roundness. In view of easier cleaning of the toner off the image carrier, however, the average roundness may be 0.91 or more and 0.98 or less, preferably 0.94 or more and 0.98 or less, more preferably 0.95 or more and 0.97 or less.

The average roundness of the toner particles is given by (circumference of the equivalent circle)/(circumference) [(circumference of circles having the same projected area as the particle images)/(circumference of the projected images of the particles)]. A specific way of determining it is as follows.

First, a number of the toner particles of interest are sampled by aspiration. By photographing the resulting flat stream with a flash, the figures of the particles therein are captured in a still image. Then the particle images are analyzed using a flow particle-image analyzer (Sysmex FPIA-3000) to determine the average roundness. The number of particles sampled in the determination of the average roundness is 3500.

If the toner contains an external additive, the toner (developer) of interest is dispersed in water containing a surfactant and sonicated. This gives toner particles isolated from the external additive.

The average roundness of the toner particles may be controlled by several methods. For example, if the toner particles are produced by aggregation and coalescence, the average roundness may be controlled by adjusting the speed of stirring of the liquid dispersion, temperature of the liquid dispersion, or time for which the liquid dispersion is maintained during fusion and coalescence.

External Additives

An example of an external additive is inorganic particles. Examples of such inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surface of the inorganic particles as an external additive may be hydrophobic as a result of treatment. An example of a hydrophobic treatment is to immerse the inorganic particles in an agent for hydrophobic treatment. Any kind of agent may be used, but examples include silane coupling agents, silicone oil, titanate coupling agents, and aluminum coupling agents. One of these may be used alone, or two or more may be used in combination.

The amount of the agent(s) for hydrophobic treatment is usually 1 part by mass or more and 10 parts by mass or less, for example, per 100 parts by mass of the inorganic particles.

Substances such as resin particles (particles of polystyrene, polymethyl methacrylate (PMMA), melamine resins, etc.) and active cleaning agents (e.g., metal salts of higher fatty acids, typically zinc stearate, and particles of fluoropolymers) are also examples of external additives.

The amount of external additives may be, for example, 0.01% by mass or more and 10% by mass or less, preferably 0.01% by mass or more and 6% by mass or less, of the toner particles.

Production of the Toner

Next is described a method for producing the specific toner.

The specific toner is obtained by producing toner particles and then adding external additive(s) to the toner particles.

The production of the toner particles may be by a dry process (e.g., kneading and milling) or a wet process (e.g., aggregation and coalescence, suspension polymerization, or dissolution and suspension). Besides these, any known process may be used to produce the toner particles.

Preferably, the toner particles are obtained by aggregation and coalescence.

If the toner particles are produced by aggregation and coalescence, an example of a specific procedure includes:

preparing a resin-particle dispersion as a liquid dispersion in which resin particles to serve as a binder resin are dispersed (preparation of a resin-particle dispersion); making the resin particles (and optionally other kind(s) of particles) aggregate in the resin-particle dispersion (or a liquid dispersion prepared by mixing with other liquid dispersion(s) of particles) to form aggregates (formation of aggregates); heating the liquid dispersion in which the aggregates are dispersed, or aggregate dispersion, to make the aggregates fuse and coalesce together, thereby forming toner particles (fusion and coalescence).

The following describes the details of each operation.

It should be noted that the method described below gives toner particles that include a coloring agent and a release agent, but the coloring agent and the release agent are optional. Naturally, additives other than a coloring agent and a release agent may also be used.

Preparation of a Resin-Particle Dispersion

First, a liquid dispersion in which resin particles to serve as a binder resin are dispersed (resin-particle dispersion) is prepared. In addition to this, a liquid dispersion in which particles of a coloring agent are dispersed (coloring-agent-particle dispersion) and a liquid dispersion in which particles of a release agent are dispersed (release agent particle dispersion), for example, are prepared.

The preparation of the resin-particle dispersion is by, for example, dispersing the resin particles in a dispersion medium using a surfactant.

The dispersion medium for the resin-particle dispersion may be, for example, an aqueous medium.

Examples of aqueous media include kinds of water, such as distilled water and ion exchange water, and alcohols. One of these may be used alone, or two or more may be used in combination.

The surfactant may be, for example, an anionic surfactant, such as a sulfate surfactant, sulfonate surfactant, phosphate surfactant, or soap surfactant; a cationic surfactant, such as an amine or quaternary ammonium surfactant; or a nonionic surfactant, such as a polyethylene glycol, alkylphenol ethylene oxide, or polyhydric alcohol surfactant, in particular an anionic or cationic surfactant. Nonionic surfactants, if used, may be used in combination with an anionic or cationic surfactant.

One surfactant may be used alone, or two or more may be used in combination.

In preparing the resin-particle dispersion, the process of dispersing the resin particles in the dispersion medium may be done by a commonly used dispersion technique, such as a rotary-shear homogenizer or a ball mill, sand mill, Dyno-Mill, or other medium mill. For certain types of resin particles, phase inversion emulsification, for example, may be used to disperse the resin particles in the resin-particle dispersion.

Phase inversion emulsification is a technique in which the resin to be dispersed is dissolved in a hydrophobic organic solvent in which the resin is soluble, the resulting organic continuous phase (O phase) is neutralized with a base, and then an aqueous medium (W phase) is added to convert the resin from W/O to O/W (so-called phase inversion), forming a discontinuous phase and thereby dispersing particles of the resin in the aqueous medium.

The volume-average diameter of the resin particles to be dispersed in the resin-particle dispersion may be, for example, 0.01 μm or more and 1 μm or less, preferably 0.08 μm or more and 0.8 μm or less, more preferably 0.1 μm or more and 0.6 μm or less.

This volume-average diameter of the resin particles is the volume-average particle diameter D50v determined as follows. The particles are analyzed using a laser-diffraction particle size analyzer (e.g., HORIBA LA-700). The measured particle size distribution is divided into segments by particle size (channels). The cumulative distribution of volume is plotted starting from the smallest diameter. The particle diameter at which the cumulative volume is 50% of that of all particles is the volume-average particle diameter D50v. For the other dispersions, too, the volume-average diameter of the particles therein is that determined by the same method.

The amount of the resin particles in the resin-particle dispersion may be, for example, 5% by mass or more and 50% by mass or less, preferably 10% by mass or more and 40% by mass or less.

The preparation of the coloring-agent-particle and release agent particle dispersions, for example, is similar to that of the resin-particle dispersion. The above discussion on the volume-average particle diameter, dispersion medium, method of dispersion, and amount for the particles in the resin-particle dispersion therefore also applies to the coloring-agent particles dispersed in the coloring-agent-particle dispersion and the release-agent particles dispersed in the release agent particle dispersion.

Formation of Aggregates

Then, the resin-particle dispersion is mixed with the coloring-agent-particle and release agent particle dispersions.

In the mixture of dispersions, the resin particles, the coloring-agent particles, and the release-agent particles are caused to aggregate together. Through this process of heteroaggregation, aggregates that include resin, coloring-agent, and release-agent particles are formed to a diameter close to the planned diameter of the toner particles.

A specific example of a procedure is as follows. A flocculant is added to the dispersion mixture, and the pH of the mixture is adjusted to an acidic level (e.g., a pH of 2 or more and 5 or less). At this point, a dispersion stabilizer may optionally be added. The dispersion mixture is then heated to a temperature close to the glass transition temperature of the resin particles (specifically, for example, a temperature higher than or equal to the resin particles' glass transition temperature minus 30° C. but not higher than the resin particles' glass transition temperature minus 10° C.) to make the particles dispersed in the mixture aggregate together, forming aggregates.

In an exemplary configuration of the formation of aggregates, the dispersion mixture may be stirred using a rotary-shear homogenizer, and the flocculant may be added at room temperature (e.g., 25° C.) while the mixture is stirred. Then the pH of the mixture is adjusted to an acidic level (e.g., a pH of 2 or more and 5 or less) and then, optionally with a dispersion stabilizer therein, heated as described above.

The flocculant may be, for example, a surfactant that has the opposite polarity to that used as a dispersant in the dispersion mixture, an inorganic metal salt, or a metal complex having a valency of 2 or more. The use of a metal complex as a flocculant improves charging characteristics by reducing the amount of surfactants used.

An additive that forms a complex or similar linkage with metal ions of the flocculant may optionally be used. This additive may be a chelating agent.

Examples of inorganic metal salts include metal salts such as calcium chloride, calcium nitrate, barium chloride, magnesium chloride, zinc chloride, aluminum chloride, and aluminum sulfate, and polymers of inorganic metal salts, such as polyaluminum chloride, polyaluminum hydroxide, and calcium polysulfide.

The chelating agent may be a water-soluble one. Examples of chelating agents include oxycarboxylic acids, such as tartaric acid, citric acid, and gluconic acid, iminodiacetic acid (IDA), nitrilotriacetic acid (NTA), and ethylenediaminetetraacetic acid (EDTA).

The amount of the chelating agent may be, for example, 0.01 parts by mass or more and 5.0 parts by mass or less, preferably 0.1 parts by mass or more and less than 3.0 parts by mass, per 100 parts by mass of resin particles.

Fusion and Coalescence

The aggregates are then caused to fuse and coalesce together and thereby to form toner particles, for example by heating the liquid dispersion in which the aggregates are dispersed, or aggregate dispersion, to at least the resin particles' glass transition temperature (e.g., to 10° C. to 30° C. higher than the resin particles' glass transition temperature or a higher temperature).

The fusion and coalescence of the aggregates into toner particles may alternatively be achieved by heating the aggregate dispersion to at least the melting temperature of the release agent. In the process of fusion and coalescence, the resin and release agent fuse together at a temperature that is higher than or equal to the glass transition temperature of the resin particles and higher than or equal to the melting temperature of the release agent. The heated aggregate dispersion is then cooled to give toner particles.

The adjustment of the aspect ratio of the release agent in the toner particles may be done by several methods. For example, the toner may be maintained near the freezing point of the release agent for a certain period of time during cooling so that crystal growth will take place, or two or more release agents with different melting temperatures may be used to accelerate crystal growth during cooling.

Through these operations, the toner particles are obtained.

Alternatively, the toner particles may be produced as follows. After the preparation of the liquid dispersion in which aggregates are dispersed (aggregate dispersion), this aggregate dispersion is mixed with another liquid dispersion in which resin particles are dispersed (resin-particle dispersion), and the resin particles and the aggregates are caused to aggregate together in such a manner that the resin particles adhere to the surface of the aggregates. This gives second aggregates. The resulting liquid dispersion in which the second aggregates are dispersed, or second-aggregate dispersion, is heated to make the second aggregates fuse and coalesce and thereby form core/shell toner particles.

After the end of fusion and coalescence, the toner particles, formed in a solution, are subjected to known operations of washing, solid-liquid separation, and drying to give dry toner particles.

The washing may be by replacement with plenty of ion exchange water in view of ease of charging. The solid-liquid separation may be by any method, but techniques such as suction filtration and pressure filtration may be used in view of productivity. The drying, too, may be by any method, but techniques such as lyophilization, flash drying, fluidized drying, and vibrating fluidized drying may be used in view of productivity.

The specific toner is then produced, for example by mixing the resulting dry toner particles with external additive(s). The mixing may be performed using, for example, a V-blender, Henschel mixer, or Lödige mixer. The toner may optionally be sieved, for example through a vibrating sieve or air-jet sieve, to remove coarse particles.

Carrier

Any type of carrier may be used, and examples include known carriers. The carrier may be, for example, a coated carrier, which is formed by covering the surface of a core magnetic powder with a coating resin; a magnetic powder-dispersed carrier, formed by dispersing and mixing a magnetic powder in a matrix resin; or a resin-impregnated carrier, formed by impregnating a porous magnetic powder with a resin.

A magnetic powder-dispersed or resin-impregnated carrier may be one formed by the constituting particles as a core and a coating resin covering this core.

Examples of magnetic powders include powders of magnetic metals, such as iron, nickel, and cobalt, and magnetic oxides, such as ferrite and magnetite.

For the coating and matrix resins, examples include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins, which include organosiloxane bonds, or their modified forms, fluoropolymers, polyester, polycarbonate, phenolic resins, and epoxy resins.

The coating and matrix resins may contain additives, such as conductive particles.

Examples of conductive particles include particles of gold, silver, copper, or any other metal, carbon black, titanium oxide, zinc oxide, tin oxide, barium sulfate, aluminum borate, and potassium titanate.

The covering of the surface of the core with a coating resin may be by, for example, covering the surface of the core using a solution of the coating resin and optionally additives in a solvent (solution for coating layer formation). The solvent may be of any kind and is selected in consideration of, for example, the coating resin used and suitability for application.

Specific examples of methods of resin coating include dipping, which means immersing the core in the solution for coating layer formation, spraying, which means spraying the solution for coating layer formation onto the surface of the core, the fluidized bed method, in which the core is caused to float on flowing air and sprayed with the solution for coating layer formation in that state, and the kneader-coater method, in which mixing of the core for the carrier with the solution for coating layer formation and removal of the solvent are performed in a kneader-coater.

For a two-component developer, the mixing ratio (by mass) between the toner and the carrier may be between 1:100 and 30:100 (toner:carrier), preferably between 3:100 and 20:100.

EXAMPLES

The following describes examples of an exemplary embodiment of the present disclosure, but the exemplary embodiment of the present disclosure is not limited to these examples. In the following description, all "parts" and "%" are by mass unless stated otherwise.

The viscosity, highest-endothermic-peak temperature, and absorbance values at certain wavelengths of the toners are measured as described above.

Developers A1 to A13 and B1 to B3

Preparation of Liquid Dispersions of Styrene-Acrylic Resin Particles

Production of Resin-Particle Dispersion (1)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1 part A solution of 4 parts of an anionic surfactant (Dowfax, Dow Chemical) in 550 parts of ion exchange water is put into a flask, and a liquid mixture of the above raw materials is added to cause emulsification. While the emulsified liquid is stirred slowly for 10 minutes, a solution of 6 parts of ammonium persulfate in 50 parts of ion exchange water is added. The system is then purged with plenty of nitrogen and heated in an oil bath until the temperature inside reaches 75° C., and polymerization is allowed to proceed for 30 minutes.

Then,

Styrene: 110 parts
n-Butyl acrylate: 50 parts
β-Carboxyethyl acrylate: 5 parts
1,10-Decanediol diacrylate: 2.5 parts
Dodecanethiol: 2 parts a liquid mixture of the above raw materials is added to cause emulsification, the emulsified liquid is added to the flask over 120 minutes, and emulsification polymerization is continued for another 4 hours. This gives a resin-particle dispersion as a liquid dispersion of resin particles having a weight-average molecular weight of 32,000, a glass transition temperature of 53° C., and a volume-average diameter of 240 nm. To this resin-particle dispersion, ion exchange water is added to adjust the solids content to 20% by mass. The resulting dispersion is resin-particle dispersion (1).

Production of Resin-Particle Dispersion (2)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1.5 parts A solution of 4 parts of an anionic surfactant (Dowfax, Dow Chemical) in 550 parts of ion exchange water is put into a flask, and a liquid mixture of the above raw materials is added to cause emulsification. While the emulsified liquid is stirred slowly for 10 minutes, a solution of 6 parts of ammonium persulfate in 50 parts of ion exchange water is added. The system is then purged with plenty of nitrogen and heated in an oil bath until the temperature inside reaches 75° C., and polymerization is allowed to proceed for 30 minutes.

Then,

Styrene: 110 parts
n-Butyl acrylate: 50 parts
β-Carboxyethyl acrylate: 5 parts
1,10-Decanediol diacrylate: 2.5 parts
Dodecanethiol: 2.5 parts a liquid mixture of the above raw materials is added to cause emulsification, the emulsified liquid is added to the flask over 120 minutes, and emulsification polymerization is continued for another 4 hours. This gives a resin-particle dispersion as a liquid dispersion of resin particles having a weight-average molecular weight of 30,000, a glass transition temperature of 53° C., and a volume-average diameter of 220 nm. To this resin-particle dispersion, ion exchange water is added to adjust the solids content to 20% by mass. The resulting dispersion is resin-particle dispersion (2).

Production of Resin-Particle Dispersion (3)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1.5 parts A solution of 4 parts of an anionic surfactant (Dowfax, Dow Chemical) in 550 parts of ion exchange water is put into a flask, and a liquid mixture of the above raw materials is added to cause emulsification. While the emulsified liquid is stirred slowly for 10 minutes, a solution of 7 parts of ammonium persulfate in 50 parts of ion exchange water is added. The system is then purged with plenty of nitrogen and heated in an oil bath until the temperature inside reaches 80° C., and polymerization is allowed to proceed for 30 minutes.

Then,

Styrene: 110 parts
n-Butyl acrylate: 50 parts
β-Carboxyethyl acrylate: 5 parts
1,10-Decanediol diacrylate: 2.5 parts
Dodecanethiol: 3.0 parts a liquid mixture of the above raw materials is added to cause emulsification, the emulsified liquid is added to the flask over 120 minutes, and emulsification polymerization is continued for another 4 hours. This gives a resin-particle dispersion as a liquid dispersion of resin particles having a weight-average molecular weight of 28,000, a glass transition temperature of 53° C., and a volume-average diameter of 230 nm. To this resin-particle dispersion, ion exchange water is added to adjust the solids content to 20% by mass. The resulting dispersion is resin-particle dispersion (3).

Production of Resin-Particle Dispersion (4)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 2.0 parts A solution of 4 parts of an anionic surfactant (Dowfax, Dow Chemical) in 550 parts of ion exchange water is put into a flask, and a liquid mixture of the above raw materials is added to cause emulsification. While the emulsified liquid is stirred slowly for 10 minutes, a solution of 7.5 parts of ammonium persulfate in 50 parts of ion exchange water is added. The system is then purged with plenty of nitrogen and heated in an oil bath until the temperature inside reaches 85° C., and polymerization is allowed to proceed for 30 minutes.

Then,

Styrene: 110 parts
n-Butyl acrylate: 50 parts
β-Carboxyethyl acrylate: 5 parts
1,10-Decanediol diacrylate: 2.5 parts
Dodecanethiol: 3.5 parts a liquid mixture of the above raw materials is added to cause emulsification, the emulsified liquid is added to the flask over 120 minutes, and emulsification polymerization is continued for another 4 hours. This gives a resin-particle dispersion as a liquid dispersion of resin particles having a weight-average molecular weight of 26,500, a glass transition temperature of 53° C., and a volume-average diameter of 210 nm. To this resin-particle dispersion, ion exchange water is added to adjust the solids content to 20% by mass. The resulting dispersion is resin-particle dispersion (4).

Production of Resin-Particle Dispersion (5)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 0.8 parts A solution of 4 parts of an anionic surfactant (Dowfax, Dow Chemical) in 550 parts of ion exchange water is put into a flask, and a liquid mixture of the above raw materials is added to cause emulsification. While the emulsified liquid is stirred slowly for 10 minutes, a solution of 5.5 parts of ammonium persulfate in 50 parts of ion exchange water is added. The system is then purged with plenty of nitrogen and heated in an oil bath until the temperature inside reaches 85° C., and polymerization is allowed to proceed for 30 minutes.

Then,

Styrene: 110 parts
n-Butyl acrylate: 50 parts
β-Carboxyethyl acrylate: 5 parts
1,10-Decanediol diacrylate: 2.5 parts
Dodecanethiol: 1.7 parts a liquid mixture of the above raw materials is added to cause emulsification, the emulsified liquid is added to the flask over 120 minutes, and emulsification polymerization is continued for another 4 hours. This gives a resin-particle dispersion as a liquid dispersion of resin particles having a weight-average molecular weight of 36,000, a glass transition temperature of 53° C., and a volume-average diameter of 260 nm. To this resin-particle dispersion, ion exchange water is added to adjust the solids content to 20% by mass. The resulting dispersion is resin-particle dispersion (5).

Preparation of Liquid Dispersion of Magenta-Colored Particles

C.I. Pigment Red 122: 50 parts
Ionic surfactant Neogen RK (DKS Co., Ltd.): 5 parts
Ion exchange water: 220 parts These ingredients are mixed together, and the resulting mixture is processed using an Ultimaizer (Sugino Machine Ltd.) for 10 minutes at 240 MPa to give a liquid dispersion of magenta-colored particles (solids concentration: 20%).

Preparation of Release agent particle dispersion (1)

Ester wax (WEP-2, NOF Corp.): 100 parts
Anionic surfactant (Neogen RK, DKS Co., Ltd.): 2.5 parts
Ion exchange water: 250 parts These materials are mixed together and heated to 120° C. After dispersion using a homogenizer (IKA ULTRA-TURRAX T50), the mixture is subjected to further dispersion using a Manton-Gaulin high-pressure homogenizer (produced by MANTON GAULIN MANUFACTURING COMPANY, INC.). This gives release agent particle dispersion (1) as a liquid dispersion of release-agent particles having a volume-average diameter of 330 nm (solids content, 29.1%).

Preparation of Release agent particle dispersion (2)

Fischer-Tropsch wax (HNP-9, Nippon Seiro Co., Ltd.): 100 parts
Anionic surfactant (Neogen RK, DKS Co., Ltd.): 2.5 parts
Ion exchange water: 250 parts These materials are mixed together and heated to 120° C. After dispersion using a homogenizer (IKA ULTRA-TURRAX T50), the mixture is subjected to further dispersion using a Manton-Gaulin high-pressure homogenizer (produced by MANTON GAULIN MANUFACTURING COMPANY, INC.). This gives release agent particle dispersion (2) as a liquid dispersion of release-agent particles having a volume-average diameter of 340 nm (solids content, 29.2%).

Preparation of Release Agent Particle Dispersion (3)

Paraffin wax (FNP0090, Nippon Seiro Co., Ltd.): 100 parts
Anionic surfactant (Neogen RK, DKS Co., Ltd.): 2.5 parts
Ion exchange water: 250 parts These materials are mixed together and heated to 120° C. After dispersion using a homogenizer (IKA ULTRA-TURRAX T50), the mixture is subjected to further dispersion using a Manton-Gaulin high-pressure homogenizer (produced by MANTON GAULIN MANUFACTURING COMPANY, INC.). This gives release agent particle dispersion (3) as a liquid dispersion of release-agent particles having a volume-average diameter of 360 nm (solids content, 29.0%).

Preparation of Release Agent Particle Dispersion (4)

Polyethylene wax (Polywax 725, produced by Toyo ADL Corp.): 100 parts
Anionic surfactant (Neogen RK, produced by DKS Co., Ltd.): 2.5 parts
Ion exchange water: 250 parts These materials are mixed together and heated to 100° C. After dispersion using a homogenizer (IKA ULTRA-TURRAX T50), the mixture is subjected to further dispersion using a Manton-Gaulin high-pressure homogenizer (produced by MANTON GAULIN MANUFACTURING COMPANY, INC.). This gives release agent particle dispersion (4) as a liquid dispersion of release-agent particles having a volume-average diameter of 370 nm (solids content, 29.3%).

Process for the Production of Toner A1

Ion exchange water: 400 parts
Resin-particle dispersion (1): 200 parts
Liquid dispersion of magenta-colored particles: 40 parts
Release agent particle dispersion (2): 12 parts
Release agent particle dispersion (3): 24 parts These ingredients are put into a reactor equipped with a thermometer, a pH meter, and a stirrer and are stirred for 30 minutes at a constant rate of 150 rpm and a constant temperature of 30° C. while the temperature is controlled from the outside using a mantle heater.

While the ingredients are dispersed using a homogenizer (ULTRA-TURRAX T50, produced by IKA Japan K.K.), a PAC aqueous solution, prepared by dissolving 2.1 parts of polyaluminum chloride (PAC, produced by Oji Paper Co., Ltd.; 30% powder) in 100 parts of ion exchange water, is added. Then the temperature is increased to 50° C., and the particle diameter is measured using a Coulter Multisizer II (aperture size, 50 μm; Coulter) to ensure that the volume-average particle diameter is 5.0 μm. Then another 115 parts of resin-particle dispersion (1) is added to attach resin particles (shell structure) to the surface of the aggregates.

Then 20 parts of a 10% by mass aqueous solution of a NTA (nitrilotriacetic acid) metal salt (CHELEST 70, produced by Chelest Corp.) is added, and the pH is adjusted to 9.0 with a 1 N aqueous solution of sodium hydroxide. Then the temperature is increased to 91° C. at an elevation rate of 0.05° C./min and maintained at 91° C. for 3 hours, and the resulting toner slurry is cooled to 85° C. and maintained for 1 hour and then cooled to 25° C. The resulting magenta toner is washed by repeated dispersion in ion exchange water and filtration until the filtrate's electrical conductivity is 20 μS/cm or less. The washed toner is vacuum-dried for 5 hours in an oven at 40° C. to give toner particles.

One hundred parts of the toner particles is mixed with 1.5 parts of hydrophobic silica (RY50, Nippon Aerosil Co., Ltd.) and 1.0 part of hydrophobic titanium oxide (T805, Nippon Aerosil Co., Ltd.) for 30 seconds at 10,000 rpm using a sample mill. The mixture is then sieved through a 45-μm-mesh vibrating sieve. The resulting material is toner A1 (toner A1 for electrostatic charge image development). The volume-average particle diameter of toner A1 is 5.7 μm.

Production of Developer A1

Eight parts of toner A1 and 92 parts of a carrier are mixed using a V-blender. The resulting mixture is developer A1 (electrostatic-charge-image developer A1).

Production of Developers A2 to A13 and B1 and B2

Magenta toners A2 to A13 and B1 and B2 are each obtained in the same way as toner A1 except that parameter changes are made as in Table 1 regarding the resin-particle dispersion, the release agent particle dispersions, the amount of flocculant, the temperature at which coalescence is performed, the temperature at which the toner slurry is maintained, and the duration for which the toner slurry is maintained at that temperature.

Then electrostatic-charge-image developers A2 to A13 and B1 and B2 are each produced in the same way as developer A1 except that the respective toners are used.

Production of Developer B3

Magenta toner B3 is obtained in the same way as toner A1 except that parameter changes are made as in Table 1 regarding the resin-particle dispersion, the release agent particle dispersions, the amount of flocculant, the temperature at which coalescence is performed, the temperature at which the toner slurry is maintained, and the duration for which the toner slurry is maintained at that temperature.

Then electrostatic-charge-image developer B3 is produced in the same way as developer A1 except that the resulting toner is used.

TABLE 1

| Toner | (Inη (T1) − Inη (T2))/(T1 − T2) | (Inη (T2) − Inη (T3))/(T2 − T3) | Inη (T0) − Inη (T1))/(T0 − T1) | (Inη (T2) − Inη (T3))/(T2 − T3) (Inη (T1) − Inη (T2))/(T1 − T2) | (Inη (T0) − Inη (T1))/(T0 − T1) (Inη (T1) − Inη (T2))/(T1 − T2) | Toner's highest-endothermic-peak temperature (° C.) | a/b | c/d |
|---|---|---|---|---|---|---|---|---|
| A1 | −0.215 | −0.090 | −0.110 | 0.125 | 0.105 | 85 | 5.0 | 2.9 |
| A2 | −0.168 | −0.080 | −0.085 | 0.088 | 0.083 | 85 | 5.1 | 2.5 |
| A3 | −0.143 | −0.100 | −0.078 | 0.043 | 0.065 | 85 | 4.9 | 2.6 |
| A4 | −0.213 | −0.090 | −0.106 | 0.123 | 0.107 | 85 | 5.0 | 2.8 |
| A5 | −0.214 | −0.100 | −0.110 | 0.114 | 0.104 | 85 | 5.1 | 2.4 |
| A6 | −0.154 | −0.135 | −0.077 | 0.019 | 0.077 | 70 | 5.1 | 2.6 |
| A7 | −0.153 | −0.133 | −0.080 | 0.020 | 0.073 | 100 | 4.9 | 2.8 |
| A8 | −0.155 | −0.141 | −0.083 | 0.014 | 0.072 | 63 | 5.0 | 2.5 |
| A9 | −0.156 | −0.136 | −0.079 | 0.020 | 0.077 | 102 | 5.1 | 2.9 |
| A10 | −0.152 | −0.141 | −0.073 | 0.011 | 0.079 | 85 | 1.5 | 1.3 |
| A11 | −0.153 | −0.142 | −0.071 | 0.011 | 0.082 | 85 | 7.2 | 3.5 |
| A12 | −0.155 | −0.135 | −0.075 | 0.020 | 0.080 | 85 | 8.5 | 4.5 |
| A13 | −0.154 | −0.134 | −0.078 | 0.020 | 0.076 | 85 | 0.7 | 0.6 |
| B1 | −0.129 | −0.090 | −0.068 | 0.039 | 0.061 | 85 | 5.3 | 2.9 |
| B2 | −0.215 | −0.155 | −0.113 | 0.060 | 0.102 | 85 | 5.3 | 2.9 |
| B3 | −0.180 | −0.186 | −0.109 | −0.006 | 0.071 | 85 | 5.3 | 2.9 |

| | | First release agent particle dispersion | | Second release agent particle dispersion | | Toner production parameters | | | |
|---|---|---|---|---|---|---|---|---|---|
| Toner | Resin-particle dispersion | Type | Parts | Type | Parts | Amount of flocculant (parts) | Coalescence temperature (° C.) | Maintenance temperature (° C.) | Duration of maintenance (hours) |
| Al | (3) | (2) | 12 | (3) | 24 | 2.1 | 91 | 85 | 1 |
| A2 | (2) | (2) | 12 | (3) | 24 | 2.1 | 92 | 85 | 1 |
| A3 | (1) | (2) | 12 | (3) | 24 | 2.1 | 93 | 85 | 1 |
| A4 | (3) | (2) | 12 | (3) | 24 | 1.9 | 92 | 85 | 1 |
| A5 | (3) | (2) | 12 | (3) | 24 | 1.7 | 91 | 85 | 1 |
| A6 | (1) | (1) | 12 | (2) | 24 | 1.7 | 77 | 70 | 1 |
| A7 | (1) | (3) | 12 | (4) | 24 | 1.7 | 108 | 95 | 1 |
| A8 | (1) | (1) | 28.8 | (2) | 7.2 | 1.7 | 70 | 65 | 1 |
| A9 | (1) | (3) | 7.2 | (4) | 28.8 | 1.7 | 108 | 95 | 1 |
| A10 | (1) | (2) | 12 | (3) | 24 | 1.7 | 91 | 85 | 0.5 |
| A11 | (1) | (2) | 12 | (3) | 24 | 1.7 | 92 | 85 | 2 |
| A12 | (1) | (2) | 12 | (3) | 24 | 1.7 | 93 | 85 | 3 |
| A13 | (1) | (2) | 12 | (3) | 24 | 1.7 | 92 | 85 | 0.25 |
| B1 | (5) | (2) | 12 | (3) | 24 | 2.1 | 91 | 85 | 1 |
| B2 | (3) | (2) | 12 | (3) | 24 | 1.5 | 93 | 85 | 1 |
| B3 | (4) | (2) | 12 | (3) | 24 | 2.1 | 93 | 85 | 1 |

Production of Toner Cartridges

Toner cartridges having a shape as in FIG. 3 are produced. First, resins including polyethylene terephthalate are shaped by injection molding into a hollow cylindrical preform that has a body, a driven cog concentric with the body, an opening at one end, and a bottom at the other end. The preform is then set in a mold for blow molding and shaped by blow molding. This gives a toner cartridge's body having a driven cog. The mold for blow molding has been designed so that the resulting body will have a ridge inside. The ridge is shaped like a spiral winding around the toner cartridge in the direction from the bottom to the opening of the body. The width, or length along the axis, of each protrusion is smaller than the distance between adjacent protrusions. The body is then loaded with one of the above toners, and a separately prepared shuttered cap is attached to the opening. The toner cartridges specified in Table 2 are produced in this way.

Examples 1 to 13 and Comparative Examples 1 to 3

The resulting developer, specified in Table 2, is loaded into the developing module of an electrophotographic copier (APEOSPORT VI C7780, produced by Fuji Xerox Co., Ltd.). Then the toner cartridge, specified in Table 2, is attached to the image forming apparatus with the toner outlet of the toner cartridge facing the toner inlet of the image forming apparatus. An ammeter is connected to the motor for the toner cartridge so that the time of operation of the motor can be measured.

Evaluation for the Transportation and Residual Amount of Replenishment Toner

A solid image with an area coverage of 100% is printed on 1000 sheets under high-temperature and high-humidity conditions (28° C. and 85% RH). Then a solid image with an area coverage of 100% is printed on 1000 sheets under low-temperature and low-humidity conditions (10° C. and 15% RH).

During printing, the weight of the toner cartridge and the time of operation of the motor for the cartridge are recorded. By dividing the total consumption of toner by the time of rotation of the toner cartridge, the rate of ejection is calculated. Besides this, the toner cartridge is weighed when the message to replace the toner cartridge is displayed. By subtracting the weight of an empty cartridge from the measured weight, the amount of toner remaining is calculated. The measured rate of ejection and amount remaining in the toner cartridge are graded in accordance with the following criteria.

Rate of Ejection (at 28° C. and 85% RH)

A: 400 mg/sec≤rate of ejection≤1100 mg/sec

B: 300 mg/sec≤rate of ejection≤1300 mg/sec

C: 200 mg/sec≤rate of ejection≤1500 mg/sec

D: 200 mg>rate of ejection or 1500 mg<rate of ejection

Amount of Toner Remaining

A: 5%≥amount remaining

B: 5%<amount remaining≤10%

C: 10%<amount remaining≤15%

D: 15%<amount remaining

TABLE 2

| | | | 28° C., 85% RH | | 10° C., 15% RH | | |
|---|---|---|---|---|---|---|---|
| | Developer | Toner cartridge | Rate measurement | Toner remaining in the cartridge after rate measurement | Rate measurement | Toner remaining in the cartridge after rate measurement | |
| Examples | 1 | A1 | A1 | A | B | A | A |
| | 2 | A2 | A2 | A | A | A | A |
| | 3 | A3 | A3 | A | A | B | B |
| | 4 | A4 | A4 | A | B | A | A |
| | 5 | A5 | A5 | B | B | A | A |
| | 6 | A6 | A6 | B | A | A | A |
| | 7 | A7 | A7 | A | A | A | A |
| | 8 | A8 | A8 | A | A | A | A |
| | 9 | A9 | A9 | A | A | A | A |
| | 10 | A10 | A10 | A | A | C | B |
| | 11 | A11 | A11 | B | B | C | C |
| | 12 | A12 | A12 | B | B | B | C |
| | 13 | A13 | A13 | B | A | A | A |
| Comparative Examples | 1 | B1 | B1 | A | A | D | D |
| | 2 | B2 | B2 | D | D | B | B |
| | 3 | B3 | B3 | D | D | C | C |

After the end of the evaluation for the transportation of replenishment toner, the inside of the body is visually inspected. In Comparative Examples, forming an image under high-temperature and high-humidity conditions results in the adhesion of replenishment toner to the protrusions inside the body, and forming an image with a high area coverage under low-temperature and low-humidity conditions results in some replenishment toner remaining inside the body. In Examples, no such phenomenon is observed.

Developers A101 to A113 and B101 to B103

Preparation of Liquid Dispersions of Amorphous Polyester Resin Particles

Production of Resin-Particle Dispersion (101)

To a dried three-neck flask are added 60 parts of dimethyl terephthalate, 74 parts of dimethyl fumarate, 30 parts of dodecenylsuccinic anhydride, 22 parts of trimellitic acid, 138 parts of propylene glycol, and 0.3 parts of dibutyltin oxide. In a nitrogen atmosphere, the reaction is allowed to proceed for 3 hours at 185° C. while the water resulting from the reaction is removed out of the system. Then the temperature is increased to 240° C. while the pressure is reduced gradually. After another 4 hours of reaction, the system is cooled. The product is amorphous polyester resin (101) and has a weight-average molecular weight of 39,000.

After the removal of any precipitate, 200 parts of amorphous polyester resin (101) is added to a separable flask together with 100 parts of methyl ethyl ketone, 35 parts of isopropyl alcohol, and 7.0 parts of a 10% by mass aqueous solution of ammonia. The materials are mixed thoroughly to dissolve the resin, and then ion exchange water is added dropwise using a delivery pump at a rate of 8 g/min while the solution is heated and stirred at 40° C. After the solution becomes uniformly turbid, the delivery of ion exchange water is continued at an increased rate of 15 g/min to induce phase inversion and terminated after 580 parts of water has been added. Then the solvents are removed under reduced pressure. The resulting liquid is liquid dispersion (101) of amorphous polyester resin particles (resin-particle dispersion (101)). The volume-average diameter and solids concentration of the resulting polyester resin particles are 170 nm and 35%, respectively.

Preparation of Resin-Particle Dispersions (102) to (105)

Resin-particle dispersions (102) to (105) are obtained in the same way as resin-particle dispersion (101) except that the polymerization is performed under the conditions specified in Table 3.

TABLE 3

| | Resin's durations of polymerization | Polyester resin's weight-average molecular weight |
|---|---|---|
| Dispersion (101) of amorphous polyester resin particles | 3 hours at 185° C., 4 hours at 240° C. | 39,000 |
| Dispersion (102) of amorphous polyester resin particles | 2.5 hours at 185° C., 3.5 hours at 240° C. | 37,000 |
| Dispersion (103) of amorphous polyester resin particles | 2 hours at 185° C., 3 hours at 240° C. | 35,000 |
| Dispersion (104) of amorphous polyester resin particles | 1.5 hours at 185° C., 2.5 hours at 240° C. | 33,000 |
| Dispersion (105) of amorphous polyester resin particles | 4 hours at 185° C., 5 hours at 240° C. | 43,000 |

Process for the Production of Toner A101

Ion exchange water: 400 parts

Liquid dispersion (101) of amorphous polyester resin particles: 200 parts

Liquid dispersion of magenta-colored particles: 40 parts

Release agent particle dispersion (2): 12 parts

Release agent particle dispersion (3): 24 parts

These ingredients are put into a reactor equipped with a thermometer, a pH meter, and a stirrer and are stirred for 30 minutes at a constant rate of 150 rpm and a constant temperature of 30° C. while the temperature is controlled from the outside using a mantle heater.

While the ingredients are dispersed using a homogenizer (ULTRA-TURRAX T50, IKA Japan K.K.), a PAC aqueous solution, prepared by dissolving 2.1 parts of polyaluminum chloride (PAC, Oji Paper Co., Ltd.; 30% powder) in 100 parts of ion exchange water, is added. Then the temperature is increased to 50° C., and the particle diameter is measured using a Coulter Multisizer II (aperture size, 50 μm; Coulter) to ensure that the volume-average particle diameter is 4.9 μm. Then another 115 parts of liquid dispersion (101) of amorphous polyester resin particles is added to attach resin particles (shell structure) to the surface of the aggregates.

Then 20 parts of a 10% by mass aqueous solution of a NTA (nitrilotriacetic acid) metal salt (CHELEST 70, Chelest Corp.) is added, and the pH is adjusted to 9.0 with a 1 N aqueous solution of sodium hydroxide. Then the temperature is increased to 91° C. at an elevation rate of 0.05° C./min and maintained at 91° C. for 3 hours, and the resulting toner slurry is cooled to 85° C. and maintained for 1 hour and then cooled to 25° C. The resulting magenta toner is washed by repeated dispersion in ion exchange water and filtration until the filtrate's electrical conductivity is 20 μS/cm or less. The washed toner is vacuum-dried for 5 hours in an oven at 40° C. to give toner particles.

One hundred parts of the toner particles is mixed with 1.5 parts of hydrophobic silica (RY50, Nippon Aerosil Co., Ltd.) and 1.0 part of hydrophobic titanium oxide (T805, Nippon Aerosil Co., Ltd.) for 30 seconds at 10,000 rpm using a sample mill. The mixture is then sieved through a 45-μm-mesh vibrating sieve. The resulting material is toner A101 (toner A101 for electrostatic charge image development). The volume-average particle diameter of toner A101 is 5.8 μm.

Production of Developer A101

Eight parts of toner A101 and 92 parts of a carrier are mixed using a V-blender. The resulting mixture is developer A101 (electrostatic-charge-image developer A101).

Production of Developers A102 to A113 and B101 and B102

Magenta toners A102 to A113 and B101 and B102 are each obtained in the same way as toner A101 except that parameter changes are made as in Table 4 regarding the resin-particle dispersion, the release agent particle dispersions, the amount of flocculant, the temperature at which coalescence is performed, the temperature at which the toner slurry is maintained, and the duration for which the toner slurry is maintained at that temperature.

Then electrostatic-charge-image developers A102 to A113 and B101 and B102 are each produced in the same way as developer A101 except that the respective toners are used.

Production of Developer B103

Magenta toner B103 is obtained in the same way as toner A101 except that parameter changes are made as in Table 4 regarding the resin-particle dispersion, the release agent particle dispersions, the amount of flocculant, the temperature at which coalescence is performed, the temperature at which the toner slurry is maintained, and the duration for which the toner slurry is maintained at that temperature.

Then electrostatic-charge-image developer B103 is produced in the same way as developer A101 except that the resulting toner is used.

TABLE 4

| Toner | (Inη (T1)-Inη (T2))/(T1-T2) | (Inη (T2)-Inη (T3))/(T2-T3) | (Inη (T0)-Inη (T1))/(T0-T1) | (Inη (T2)-Inη (T3))/(T2-T3) - (Inη (T1)-Inη (T2))/(T1-T2) | (Inη (T0)-(Inη (T1))/(T0-T1) - (Inη (T1)-Inη (T2))/(T1-T2) | Toner's highest-endothermic-peak temperature (° C.) | a/b | c/d | 1,500 $cm^{-1}$/720 $cm^{-1}$ | 820 $cm^{-1}$/720 $cm^{-1}$ | Resin-particle dispersion | First release agent particle dispersion Type | First release agent particle dispersion Parts | Second release agent particle dispersion Type | Second release agent particle dispersion Parts | Toner production parameters: Amount of flocculant (parts) | Toner production parameters: Coalescence temperature (° C.) | Toner production parameters: Maintenance temperature (° C.) | Toner production parameters: Duration of maintenance (hours) |
|---|---|---|---|---|---|---|---|---|---|---|---|---|---|---|---|---|---|---|---|
| A101 | −0.220 | −0.110 | −0.100 | 0.110 | 0.120 | 85 | 5.2 | 2.7 | 0.30 | 0.16 | (103) | (2) | 12 | (3) | 24 | 2.1 | 91 | 85 | 1 |
| A102 | −0.163 | −0.070 | −0.080 | 0.093 | 0.083 | 85 | 4.9 | 2.3 | 0.31 | 0.15 | (102) | (2) | 12 | (3) | 24 | 2.1 | 92 | 85 | 1 |
| A103 | −0.141 | −0.100 | −0.065 | 0.041 | 0.076 | 85 | 4.8 | 2.7 | 0.29 | 0.17 | (101) | (2) | 12 | (3) | 24 | 2.1 | 93 | 85 | 1 |
| A104 | −0.222 | −0.080 | −0.111 | 0.142 | 0.111 | 85 | 5.2 | 2.7 | 0.33 | 0.16 | (103) | (2) | 12 | (3) | 24 | 1.9 | 92 | 85 | 1 |
| A105 | −0.211 | −0.110 | −0.101 | 0.101 | 0.110 | 85 | 5.0 | 2.5 | 0.34 | 0.17 | (103) | (2) | 12 | (3) | 24 | 1.7 | 91 | 85 | 1 |
| A106 | −0.156 | −0.131 | −0.075 | 0.025 | 0.081 | 70 | 4.9 | 2.4 | 0.30 | 0.16 | (101) | (1) | 12 | (2) | 24 | 1.7 | 77 | 70 | 1 |
| A107 | −0.154 | −0.135 | −0.072 | 0.019 | 0.082 | 100 | 4.7 | 2.9 | 0.29 | 0.15 | (101) | (3) | 12 | (4) | 24 | 1.7 | 108 | 95 | 1 |
| A108 | −0.155 | −0.139 | −0.079 | 0.016 | 0.076 | 85 | 1.6 | 1.4 | 0.33 | 0.17 | (101) | (2) | 12 | (3) | 24 | 1.7 | 91 | 85 | 0.5 |
| A109 | −0.154 | −0.141 | −0.077 | 0.013 | 0.077 | 85 | 7.1 | 3.3 | 0.29 | 0.18 | (101) | (2) | 12 | (3) | 24 | 1.7 | 92 | 85 | 2 |
| A110 | −0.151 | −0.136 | −0.072 | 0.015 | 0.079 | 63 | 5.2 | 2.9 | 0.27 | 0.16 | (103) | (1) | 28.8 | (2) | 7.2 | 1.7 | 70 | 65 | 1 |
| A111 | −0.153 | −0.140 | −0.081 | 0.013 | 0.072 | 102 | 5.1 | 2.5 | 0.34 | 0.17 | (103) | (3) | 7.2 | (4) | 28.8 | 1.7 | 108 | 95 | 1 |
| A112 | −0.152 | −0.133 | −0.080 | 0.019 | 0.072 | 85 | 8.6 | 4.6 | 0.33 | 0.16 | (103) | (2) | 12 | (3) | 24 | 1.7 | 93 | 85 | 3 |
| A113 | −0.151 | −0.133 | −0.071 | 0.018 | 0.080 | 85 | 0.8 | 0.5 | 0.31 | 0.15 | (103) | (2) | 12 | (3) | 24 | 1.7 | 92 | 85 | 0.25 |
| B101 | −0.127 | −0.110 | −0.055 | 0.017 | 0.072 | 85 | 5.0 | 2.7 | 0.34 | 0.16 | (105) | (2) | 12 | (3) | 24 | 2.1 | 91 | 85 | 1 |
| B102 | −0.221 | −0.160 | −0.132 | 0.061 | 0.089 | 85 | 5.1 | 2.8 | 0.28 | 0.18 | (103) | (2) | 12 | (3) | 24 | 1.5 | 93 | 85 | 1 |
| B103 | −0.203 | −0.224 | −0.119 | −0.021 | 0.084 | 85 | 5.3 | 3.0 | 0.36 | 0.17 | (104) | (2) | 12 | (3) | 24 | 1.5 | 93 | 85 | 1 |

Production of Toner Cartridges

The toner cartridges specified in Table 5 are produced in the same way as those used in Examples 1 to 13 and Comparative Examples 1 to 3 except that the toners are changed to toners A101 to A113 and B101 to B103.

Examples 101 to 113 and Comparative Examples 101 to 103

The resulting developer, specified in Table 5, is loaded into the developing module of an electrophotographic copier (APEOSPORT VI C7780, produced by Fuji Xerox Co., Ltd.). Then the toner cartridge, specified in Table 5, is attached to the image forming apparatus with the toner outlet of the toner cartridge facing the toner inlet of the image forming apparatus. An ammeter is connected to the motor for the toner cartridge so that the time of operation of the motor can be measured.

Evaluation for the Transportation and Residual Amount of Replenishment Toner

A solid image with an area coverage of 100% is printed on 1000 sheets under high-temperature and high-humidity conditions (28° C. and 85% RH). Then a solid image with an area coverage of 100% is printed on 1000 sheets under low-temperature and low-humidity conditions (10° C. and 15% RH).

During printing, the weight of the toner cartridge and the time of operation of the motor for the cartridge are recorded. By dividing the total consumption of toner by the time of rotation of the toner cartridge, the rate of ejection is calculated. Besides this, the toner cartridge is weighed when the prompt to replace the toner cartridge is issued. By subtracting the weight of an empty cartridge from the measured weight, the amount of toner remaining is calculated. The results are graded in accordance with the following criteria.

Rate of Ejection

A: 400 mg/sec≤rate of ejection≤1100 mg/sec

B: 300 mg/sec≤rate of ejection≤1300 mg/sec

C: 200 mg/sec≤rate of ejection≤1500 mg/sec

D: 200 mg>rate of ejection or 1500 mg<rate of ejection

Amount of Toner Remaining

A: 5%≥amount remaining

B: 5%<amount remaining≤10%

C: 10%<amount remaining≤15%

D: 15%<amount remaining

TABLE 5

| | | | 28° C., 85% RH | | 10° C., 15% RH | | |
|---|---|---|---|---|---|---|---|
| | Developer | Toner cartridge | Rate measurement | Toner remaining in the cartridge after rate measurement | Rate measurement | Toner remaining in the cartridge after rate measurement | |
| Examples | 101 | A101 | A101 | A | B | A | A |
| | 102 | A102 | A102 | A | A | A | A |
| | 103 | A103 | A103 | B | B | B | B |
| | 104 | A104 | A104 | B | B | A | A |
| | 105 | A105 | A105 | B | B | A | A |
| | 106 | A106 | A106 | B | A | A | A |
| | 107 | A107 | A107 | A | A | C | B |
| | 108 | A108 | A108 | A | A | A | A |
| | 109 | A109 | A109 | B | A | A | A |
| | 110 | A110 | A110 | A | A | C | B |
| | 111 | A111 | A111 | A | A | A | A |
| | 112 | A112 | A112 | A | A | A | A |
| | 113 | A113 | A113 | B | B | C | C |
| Comparative Examples | 101 | B101 | B101 | A | A | D | D |
| | 102 | B102 | B102 | D | D | C | C |
| | 103 | B103 | B103 | D | D | C | C |

After the end of the evaluation for the transportation of replenishment toner, the inside of the body is visually inspected. In Comparative Examples, forming an image under high-temperature and high-humidity conditions results in the adhesion of replenishment toner to the protrusions inside the body, and forming an image with a high area coverage under low-temperature and low-humidity conditions results in some replenishment toner remaining inside the body. In Examples, no such phenomenon is observed.

Overall, the image forming apparatuses of Examples, which use toners that satisfy the relations of the $(\ln \eta(T1)-\ln \eta(T2))/(T1-T2)$ being −0.14 or less, the $(\ln \eta(T2)-\ln \eta(T3))/(T2-T3)$ being −0.15 or more, and the $(\ln \eta(T2)-\ln \eta(T3))/(T2-T3)$ being greater than the $(\ln \eta(T1)-\ln \eta(T2))/(T1-T2)$, rarely suffer inadequate supply of replenishment toner in comparison with those of Comparative Examples, which use toners that fail to satisfy at least one of these relations, even when forming an image under high-temperature and high-humidity conditions or an image with a high area coverage under low-temperature and low-humidity conditions.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image carrier;

a charging section that charges a surface of the image carrier;

an electrostatic-charge-image-forming section that forms an electrostatic charge image on the charged surface of the image carrier;

a developing section that contains toner and develops the electrostatic charge image on the surface of the image carrier into a toner image using the toner;

a replenishment toner supplying section that supplies the toner to the developing section, the replenishment toner supplying section including a replenishment toner cartridge having an axis of rotation of the replenishment toner cartridge and having a cap and a body containing the toner, and detachably attached to the image forming apparatus, the cap being at the axial end of the replenishment toner cartridge and having an outlet for the replenishment toner to be ejected therethrough, whereas the body having a ridged portion by which the toner inside is moved in a direction from the other axial end of the replenishment toner cartridge to the outlet as the body rotates;

a transfer section that transfers the toner image formed on the surface of the image carrier to a surface of a recording medium; and a fixing section that fixes the toner image transferred to the surface of the recording medium, the toner satisfying the following relations:

$$(\ln \eta(T1)-\ln \eta(T2))/(T1-T2)\leq -0.14;$$

$$(\ln \eta(T2)-\ln \eta(T3))/(T2-T3)\geq -0.15; \text{ and}$$

$$(\ln \eta(T1)-\ln \eta(T2))/(T1-T2)<(\ln \eta(T2)-\ln \eta(T3))/(T2-T3),$$

where $\eta(T1)$ represents a viscosity of the toner at 60° C., $\eta(T2)$ represents a viscosity of the toner at 90° C., and $\eta(T3)$ represents a viscosity of the toner at 130° C.

2. The image forming apparatus according to claim 1, wherein the toner has a $(\ln \eta(T0)-\ln \eta(T1))/(T0-T1)$, where $\eta(T0)$ is a viscosity $\eta$ of the toner at T0=40° C., of −0.12 or more, and the $(\ln \eta(T0)-\ln \eta(T1))/(T0-T1)$ is greater than the $(\ln \eta(T1)-\ln \eta(T2))/(T1-T2)$.

3. The image forming apparatus according to claim 1, wherein the toner has a $(\ln \eta(T1)-\ln \eta(T2))/(T1-T2)$ of −0.16 or less.

4. The image forming apparatus according to claim 1, wherein the toner has a $(\ln \eta(T2)-\ln \eta(T3))/(T2-T3)$ of −0.13 or more.

5. The image forming apparatus according to claim 1, wherein:

the toner contains a release agent; and the following relation is satisfied:

$$1.0<a/b<8.0$$

where a and b are numbers of the release agent with an aspect ratio of 5 or more and smaller than 5, respectively, in the toner.

6. The image forming apparatus according to claim 1, wherein:

the toner contains a release agent; and the following relation is satisfied:

$$1.0<c/d<4.0$$

where c and d are areas of the release agent with an aspect ratio of 5 or more and smaller than 5, respectively, in the toner.

7. The image forming apparatus according to claim 1, wherein the toner has a highest-endothermic-peak temperature between 70° C. and 100° C.

8. The image forming apparatus according to claim 1, wherein the toner has a highest-endothermic-peak temperature between 75° C. and 95° C.

9. The image forming apparatus according to claim 1, wherein the toner contains a styrene-acrylic resin as a binder resin.

10. The image forming apparatus according to claim 1, wherein the toner contains an amorphous polyester resin as a binder resin.

11. The image forming apparatus according to claim 1, wherein the body of the replenishment toner cartridge contains at least one polyester or polyolefin as a constituent material or materials.

12. The image forming apparatus according to claim 11, wherein the polyester includes polyethylene terephthalate, and the polyolefin includes at least one of polyethylene and polypropylene.

13. The image forming apparatus according to claim 1, wherein the ridged portion is shaped like a spiral winding around the replenishment toner cartridge in a direction from the other axial end to the axial end.

14. The image forming apparatus according to claim 1, wherein in the ridged portion formed by a protrusion, a width of the protrusion is smaller than a distance between adjacent protrusions.

15. The image forming apparatus according to claim 1, wherein the axis of rotation is parallel with a substantially horizontal direction.

16. A toner cartridge comprising:

a chamber that contains toner for electrostatic charge image development, the toner satisfying the following relations:

$$(\ln \eta(T1)-\ln \eta(T2))/(T1-T2)\leq -0.14;$$

$$(\ln \eta(T2)-\ln \eta(T3))/(T2-T3)\geq -0.15; \text{ and}$$

$$(\ln \eta(T1)-\ln \eta(T2))/(T1-T2)<(\ln \eta(T2)-\ln \eta(T3))/(T2-T3),$$

where $\eta(T1)$ represents a viscosity of the toner at 60° C., $\eta(T2)$ represents a viscosity of the toner at 90° C., and $\eta(T3)$ represents a viscosity of the toner at 130° C.

* * * * *